US009978309B2

(12) United States Patent
Nonaka et al.

(10) Patent No.: US 9,978,309 B2
(45) Date of Patent: May 22, 2018

(54) PIXEL CIRCUIT AND DRIVING METHOD THEREOF

(71) Applicant: NLT TECHNOLOGIES, LTD., Kanagawa (JP)

(72) Inventors: Yoshihiro Nonaka, Kanagawa (JP); Yojiro Matsueda, Kanagawa (JP); Kenichi Takatori, Kanagawa (JP)

(73) Assignee: NLT TECHNOLOGIES, LTD., Kanagawa (JP)

( * ) Notice: Subject to any disclaimer, the term of this patent is extended or adjusted under 35 U.S.C. 154(b) by 44 days.

(21) Appl. No.: 14/752,218

(22) Filed: Jun. 26, 2015

(65) Prior Publication Data

US 2015/0379956 A1 Dec. 31, 2015

(30) Foreign Application Priority Data

Jun. 27, 2014 (JP) ..... 2014-133382
Feb. 20, 2015 (JP) ..... 2015-031373

(51) Int. Cl.

| | |
|---|---|
| ***G09G 3/38*** | (2006.01) |
| ***G09G 3/32*** | (2016.01) |
| ***G09G 3/325*** | (2016.01) |
| ***G09G 3/3233*** | (2016.01) |

(52) U.S. Cl.

CPC ..... *G09G 3/325* (2013.01); *G09G 3/3233* (2013.01); *G09G 2300/08* (2013.01); *G09G 2300/0842* (2013.01); *G09G 2300/0895* (2013.01); *G09G 2320/0238* (2013.01); *G09G 2320/0257* (2013.01); *G09G 2320/045* (2013.01)

(58) Field of Classification Search

CPC .... G09G 3/38; G09G 3/03233; G09G 3/3258; G09G 3/3291; G09G 3/325
USPC ..... 315/172
See application file for complete search history.

(56) References Cited

U.S. PATENT DOCUMENTS 9,324,258 B2 * 4/2016 Tsuge ..... G09G 3/30
9,640,601 B2 5/2017 Kim
(Continued)

FOREIGN PATENT DOCUMENTS

JP 2012-128386 A 7/2012
JP 2013-210407 * 10/2013
(Continued)

OTHER PUBLICATIONS

Communication dated Mar. 2, 2018 from the United States Patent and Trademark Office in counterpart U.S. Appl. No. 15/857,275.

*Primary Examiner* — Daniel D Chang
(74) *Attorney, Agent, or Firm* — Sughrue Mion, PLLC

(57) ABSTRACT

To prevent image retention, the pixel circuit includes: a light emitting element; a driving transistor which supplies an electric current according to an applied voltage to the light emitting element; a capacitor part which holds the voltage containing a threshold voltage and a data voltage of the driving transistor; and a switch part which has the voltage containing the threshold voltage and the data voltage held to the capacitor part and applies the voltage to the driving transistor. Further, the switch part has a function which applies a constant voltage to the driving transistor before having the voltage containing the threshold voltage and the data voltage held to the capacitor part.

1 Claim, 27 Drawing Sheets

(56) References Cited

U.S. PATENT DOCUMENTS

| | | | | |
|---|---|---|---|---|
| 2014/0034923 | A1 | 2/2014 | Kim et al. | |
| 2014/0340290 | A1* | 11/2014 | Ono ..... | G09G 3/3233 345/77 |

FOREIGN PATENT DOCUMENTS

| | | | |
|---|---|---|---|
| JP | 2013-210407 | A | 10/2013 |
| JP | 2014-29533 | A | 2/2014 |

* cited by examiner

PIXEL CIRCUIT AND DRIVING METHOD THEREOF

CROSS-REFERENCE TO RELATED APPLICATION

This application is based upon and claims the benefit of priority from Japanese patent application No. 2014-133382, filed on Jun. 27, 2014 and Japanese patent application No. 2015-031373, filed on Feb. 20, 2015, the disclosure of which is incorporated herein in its entirety by reference.

BACKGROUND OF THE INVENTION

1. Field of the Invention

The present invention relates to a pixel circuit and a driving method used in an Active Matrix Organic Light Emitting Display (referred to as "AMOLED", hereinafter) and the like. An organic light emitting diode is also referred to as an organic EL element (referred hereinafter as "OLED").

2. Description of the Related Art

There is no standard pixel circuit of AMOLED, so that each of the companies manufacturing AMOLED uses their original pixel circuits. A typical pixel circuit is provided with OLED, a drive transistor for driving the OLED, a plurality of transistors for switches, a capacitor, and the like.

In order to compensate variations and fluctuations of a threshold voltage of a driving transistor which supplies an electric current to the OLED in the pixel circuit, some techniques for detecting the threshold voltage is known (see Japanese Unexamined Patent Publication 2014-029533 (Patent Document 1) and Japanese Unexamined Patent Publication 2013-210407 (Patent Document 2), for example). The mainstreams of the techniques for detecting the threshold voltage are the following two types of techniques.

(1) A method with which: a gate terminal and a drain terminal are connected; the potential of a source terminal, for example, is fixed; and the potential of the gate terminal is changed by an electric current between the source and the drain to bring the voltage between the gate and the source automatically to be close to the threshold voltage (diode connection type). (2) A method with which: the potential of a gate terminal is fixed; the potential of a source terminal is changed by an electric current between the drain and the source to bring the voltage between the gate and the source automatically to be close to the threshold voltage (source follower type). The source follower type is advantageous in being able to detect the threshold voltage of a depression type transistor in which an electric current is flown even when the voltage between the gate and the source is 0 V.

However, the existing pixel circuit with a threshold voltage detecting function has following issues.

(1) When white display is shown after showing black display for a while, due to the hysteresis characteristic of the driving transistor, the screen does not change to white immediately but the time for several frames are required to turn to all-white display. This is called "image retention" in general (see Japanese Unexamined Patent Publication 2012-128386 (Patent Document 3), for example). In other words, the hysteresis characteristic of the driving transistor is initialized when an electric current is not flown to the driving transistor for a long time, so the threshold voltage shifts to a direction of increasing the electric current. Under such state, even if the gate-source voltage for white-display compensating the threshold voltage applies to the driving transistor, the electric current is decreased instantly due to the hysteresis characteristic. Therefore, the brightness of the original white display cannot be acquired.

(2) Due to leaked light emission in a non-emission period, the contrast deterioration occurs. The reason is that the electric current as following cases is flown into the OLED during the non-emission period so that invalid leaked light emission is generated. (a) The electric current for the driving transistor flows via the OLED in a threshold voltage detecting period. (b) The charged electric current of the capacitor flows via the OLED in a capacitor-reset period.

Next, the related techniques will be described. Reference numbers in FIG. 24A to FIG. 27B are directly employed from the publications for just explanation purpose, so that those reference numbers are irrelevant to the reference numbers of other drawings in this invention.

(Related Art 1)

Related Art 1 shown in FIG. 24A and FIG. 24B is depicted in FIG. 1 and FIG. 2 of Patent Document 1.

A pixel circuit 200 of Related Art 1 includes an OLED 10, a driving transistor 14, switching transistors 16, 18, a capacitor 12, and the like, and discloses a following subject and feature. The pixel circuit 200 is of a source follower type, in which the switching transistor 18 is connected to the anode of the OLED 10. The pixel circuit 200 does not detect a threshold voltage at which an electric current does not flow. The pixel circuit 200 flows a prescribed bias current to the driving transistor 14 via a bias line IBIAS to adjust the potential of a source terminal B11. The potential of the source terminal B11 is applied to the OLED 10 when the supply voltage VDD is not decreased at programming cycles X11 and X12. Therefore, leaked light emission is generated, and the electric current flown to the driving transistor 14 cannot be brought up to the prescribed bias current.

(Related Art 2)

Related Art 2 shown in FIG. 25A and FIG. 25B is depicted in FIG. 26 and FIG. 27 of Patent Document 1.

A pixel circuit 420 of Related Art 2 includes an OLED 422, a driving transistor 426, switching transistors 428, 430, 432, 434, 436, a capacitor 424, and the like, and discloses a following subject and feature. The pixel circuit 420 is of a source follower type, in which the switching transistor 436 is connected to the source terminal of the driving transistor 426. The switching transistor is not connected to the anode of the OLED 422. The pixel circuit 420 does not detect a threshold voltage. The pixel circuit 420 flows prescribed bias current to the driving transistor 426 via a bias line Ibias to adjust the potential of a source terminal. The prescribed bias current will flow to the OLED 422 in a non-emission period X71, and leaked light emission is generated.

(Related Art 3)

Related Art 3 shown in FIG. 26A and FIG. 26B is depicted in FIG. 16 and FIG. 25 of Patent Document 1.

A pixel circuit 210 of Related Art 3 includes an OLED 90, a driving transistor 96, switching transistors 98, 100, 102, 104, capacitors 92, 94, and the like, and discloses a following subject and feature. The pixel circuit 210 is of a diode connection type, in which the switching transistor 96 is connected to the anode of the OLED 90. The pixel circuit 210 does not detect a threshold voltage. In the pixel circuit 210, a prescribed bias current flows to the driving transistor 96 via a bias line IBIAS to adjust the voltage between the gate and the drain. The voltage of the node C32 will apply to the OLED 90 if the supply voltage VDD is not decreased at a programming cycle X61. Therefore, leaked light emission is generated, and the prescribed bias current cannot be flown to the driving transistor 96.

(Related Art 4)

Related Art 4 shown in FIG. 27A and FIG. 27B is depicted in FIG. 2 and FIG. 4 of Patent Document 2.

A pixel circuit 2A of Related Art 4 includes an OLED 3, a driving transistor T2, switching transistors T1, T3, T4, T5, T6, a capacitor C1, and the like, and discloses a following subject and feature. The pixel circuit 2A is of a diode connection type, in which the switching transistor T6 is connected to the anode terminal of the OLED 3. The switching transistor T6 is used only for fixing the potential of the anode terminal but not used for resetting the terminal of the driving transistor T2 and for preventing image retention. That is, there is no simultaneous conduction of the switching transistor T6 and the switching transistor T4.

Therefore the present invention provides a pixel circuit and the like preventing the image retention as firstly and the contrast deterioration caused due to leaked light emission in a non-emission period as secondly.

SUMMARY OF THE INVENTION

The pixel circuit according to an exemplary aspect of the invention is a pixel circuit which includes: a light emitting element; a driving transistor which supplies an electric current according to an applied voltage to the light emitting element; a capacitor part which holds a voltage containing a threshold voltage and a data voltage of the driving transistor; and a switch part which makes the capacitor part hold the voltage containing the threshold voltage and the data voltage and applies the voltage to the driving transistor, wherein the switch part includes a function which applies a constant voltage to the driving transistor before making the capacitor part hold the voltage containing the threshold voltage and the data voltage.

The pixel circuit driving method according to another exemplary aspect of the invention is a method for driving the pixel circuit which includes a light emitting element, a driving transistor, a capacitor part, and a switch part, and the method includes: a first period where the switch part initializes a voltage held to the capacitor part, and applies a constant voltage to the driving transistor to turn on the driving transistor temporarily; a second period where the switch part makes the capacitor part hold a voltage containing a threshold voltage and a data voltage of the driving transistor; and a third period where the switch part applies the voltage held to the capacitor part to the driving transistor, so that the driving transistor supplies an electric current according to the voltage applied by the switch part to the light emitting element.

DETAILED DESCRIPTION OF THE PREFERRED EMBODIMENTS

Figure 1A:
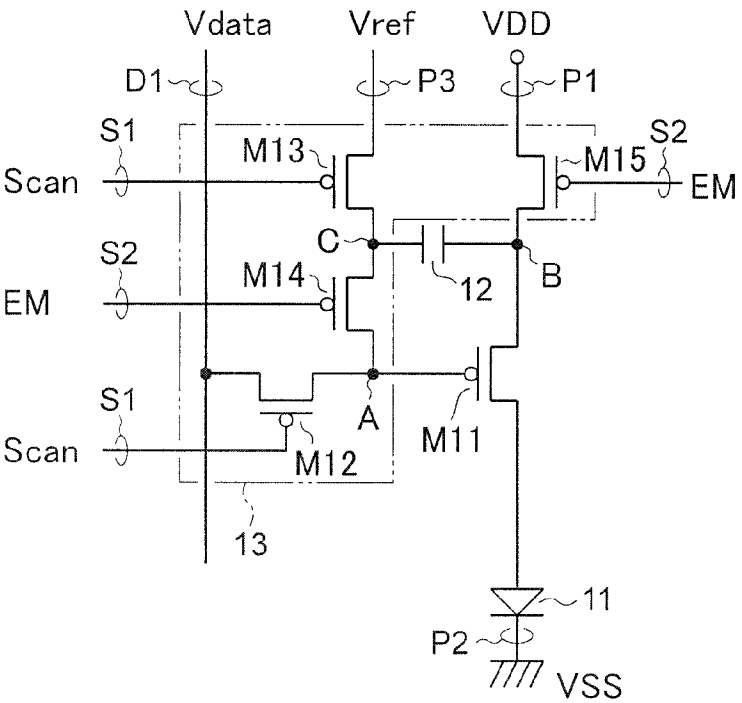
FIG. 1A is a circuit diagram showing the structure of a pixel circuit according to a first exemplary embodiment.

The exemplary embodiments of the present invention will be described hereinafter by referring to the accompanying drawings. In the current Specification and drawings, same reference number is used for substantially same structural element unless there is any specific remark being made. Shapes in the drawings are illustrated to be easily comprehended by those skilled in the art, so that dimensions and ratios thereof are not necessarily consistent with the actual ones. "Comprise" in the current Specification and the scope of the appended claims also includes cases having an element other than those depicted therein. "Have", "include", and the like are also the same. "Connect" in the current Specification and the scope of the appended claims means not only a case of connecting two elements directly but also a case of connecting two elements via another element. "Link" and the like are also the same. "On" and "off" of a transistor can be rewritten as "conductive" and "non-conductive", respectively.

First Exemplary Embodiment

Figure 1B:
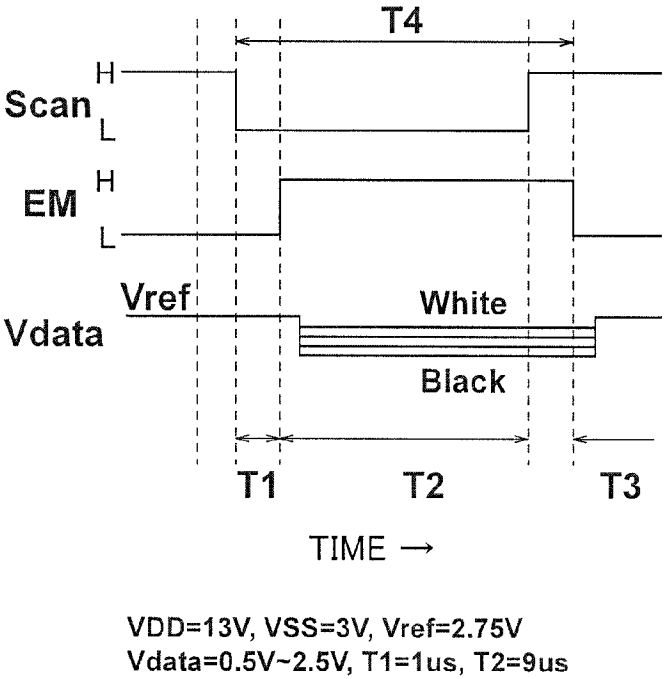
FIG. 1B is a timing chart showing actions of the pixel circuit of the first exemplary embodiment.

FIG. 1A is a circuit diagram showing the structure of a pixel circuit according to a first exemplary embodiment, and FIG. 1B is a timing chart showing operations of the pixel circuit of the first exemplary embodiment. Explanations will be provided hereinafter by referring to those drawings.

A pixel circuit 10 of the first exemplary embodiment includes: a light emitting element 11; a driving transistor (M11) which supplies an electric current to the light emitting element 11 according to an applied voltage; a capacitor part (12) which holds a voltage containing a threshold voltage Vth and a data voltage Vdata of the driving transistor (M11); and a switch part 13 which has the voltage containing the threshold voltage Vth and the data voltage Vdata held to the capacitor part (12) and applies these voltage to the driving transistor (M11). Further, the switch part 13 has a function which applies a constant voltage for preventing initialization of hysteresis characteristics to the driving transistor (M11) before having the voltage containing the threshold voltage Vth and the data voltage Vdata held to the capacitor part (12).

With the pixel circuit 10, a constant voltage is applied to the driving transistor (M11) before having the voltage containing the threshold voltage Vth and the data voltage Vdata held to the capacitor part (12). Thereby, an electric current can be flown to the driving transistor (M11) securely before supplying an electric current to the light emitting element 11. Thus, the hysteresis characteristic of the driving transistor (M11) can be prevented from becoming initialized, so that the image retention can be prevented.

In more detail, the driving transistor (M11) includes the gate terminal, the source terminal, and the drain terminal, and supplies the electric current according to the voltage applied between the gate terminal and the source terminal to the light emitting element 11 connected in series to the drain terminal and the source terminal. The switch part 13 includes: a data voltage transistor (M12) which inputs the data voltage Vdata from a data supply line (D1); a reference voltage transistor (M13) which inputs the reference voltage Vref from a reference voltage line (P3); a gate voltage transistor (M14) which applies the voltage held to the capacitor part (12) between the gate terminal and the source terminal of the driving transistor (M11); and a power switching transistor (M15) which functions as a switch for flowing an electric current to the drain terminal and the source terminal of the driving transistor (M11) from a power supply voltage line (P1).

Further, the switch part 13 applies a constant voltage between the gate terminal and the source terminal of the driving transistor (M11) by turning on the data voltage transistor (M12), the reference voltage transistor (M13), the gate voltage transistor (M14), and the power switching transistor (M15) (a first period T1). The voltage containing the threshold voltage Vth and the data voltage Vdata has been held in the capacitor part (12) by turning off the data voltage transistor (M12), the reference voltage transistor (M13), the gate voltage transistor (M14), and the power switching transistor (M15) (a second period T2). And the voltage held in the capacitor part (12) is applied between the gate terminal and the source terminal of the driving transistor (M11) by turning off the data voltage transistor (M12) and the reference voltage transistor (M13) and turning on the gate voltage transistor (M14) and the power switching transistor (M15) (a third period T3). The first period T1 and the second period T2 are included in a non-emission period T4.

In more detail, the pixel circuit 10 is electrically connected to the data line D1, first and second control lines S1, S2, and first to third power supply lines P1 to P3, and includes the first to fifth transistors M11 to M15, the capacitor 12, and the light emitting element 11.

The light emitting element 11 includes a first terminal and a second terminal that is electrically connected to the second power supply line P2. The first transistor M11 includes a first terminal, a second terminal electrically connected to the first terminal of the light emitting element 11, and a control terminal. The second transistor M12 includes: a first terminal electrically connected to the data line D1; a second terminal connected to the control terminal of the first transistor M11, and a control terminal electrically connected to the first control line S1. The third transistor M13 includes: a first terminal electrically connected to the third power supply line P3; a second terminal; and a control terminal electrically connected to the first control line S1. The fourth transistor M14 includes: a first terminal electrically connected to the second terminal of the third transistor M13; a second terminal electrically connected to the control terminal of the first transistor M11; and a control terminal electrically connected to the second control line S2. The fifth transistor M15 includes: a first terminal electrically connected to the first power supply line P1; a second terminal electrically connected to the first terminal of the first transistor M11; and a control terminal electrically connected to the second control line S2. The capacitor 12 includes: a first terminal electrically connected to the second terminal of the third transistor M13; and a second terminal electrically connected to the first terminal of the first transistor M11.

Note here that the first transistor M11 corresponds to the above-described "driving transistor", the part consisted of the second to the fifth transistors M12 to M15 to the above-described "switch part 13", and the capacitor 12 to the above-described "capacitor part", respectively. Further, the data line D1 corresponds to the above-described "data supply line", the first power supply line P1 to the above-described "power supply voltage line", and the third power supply line P3 to the above-described "reference voltage line", respectively. The first terminal, the second terminal, and the control terminal of the first transistor M11 correspond to the above-described "source terminal, drain terminal, and gate terminal of the driving transistor". The second transistor M12 corresponds to the above-described "data voltage transistor", the third transistor M13 to the above-described "reference voltage transistor", the fourth transistor M14 to the above-described "gate voltage transistor", and the fifth transistor M15 to the above-described "power switching transistor", respectively.

The first control line S1 outputs a first control signal Scan, and the second control line S2 outputs a second control signal EM. The first power supply line P1 supplies a first power supply voltage VDD, the second power supply line P2 supplies a second power supply voltage VSS, the third power supply line P3 supplies the reference voltage Vref, and the data line D1 supplies the data voltage Vdata. In each transistor, the first terminal is one of the source terminal and the drain terminal, for example. The second terminal is the other one of the source terminal and the drain terminal. The control terminal is the gate terminal, for example. The first terminal of the light emitting element 11 is one of the anode terminal and the cathode terminal (e.g., the anode terminal in the first exemplary embodiment), and the second terminal of the light emitting element 11 is the other one of the anode terminal and the cathode terminal (e.g., the cathode terminal in the first exemplary embodiment).

The first to fifth transistors M11 to M15 are p-channel type transistors. More specifically, those are p-channel type TFTs. The light emitting element 11 is OLED. In general, the substrate side (VSS side) is the cathode in the OLED. Thus, for connecting its anode to the drain of the driving transistor, the driving transistor needs to be a p-channel type. Thereby, the OLED can be connected to the drain side, so that a constant current can be supplied to the OLED at all times even when the resistance value of the OLED changes as the time passes.

The transistor M11 as the driving transistor is an amplifying transistor operated in a saturated region. The second to fifth transistors M12 to M15 constituting the switch part 13 is the switch transistors operated in a linear region.

The capacitor part (12) may be constituted with two or more capacitors, and the switch part 13 may be constituted with six or more transistors.

Next, the pixel circuit 10 will be described from another viewpoint.

The pixel circuit 10 includes: the light emitting element 11; the first transistor M11 as the driving transistor whose drain terminal is connected to the first terminal of the light emitting element 11; the second transistor M12 which links the data line D1 for supplying a programming voltage to the gate terminal (node A) of the first transistor M11 and is gate-controlled by the first control signal Scan; the third transistor M13 which links one end (node C) of the capacitor 12 as the retention capacity whose other end (node B) being connected to the source terminal of the first transistor M11 to the third power supply line P3 and is gate-controlled by the first control signal Scan; the fourth transistor M14 which links the end (node C) of the capacitor 12 to the gate terminal (node A) of the first transistor M11 and is gate-controlled by a second control signal EM; and the fifth transistor M15 which links one end (node B) of the capacitor 12 to the first power supply line P1 and is gate-controlled by the second control signal EM.

In the pixel circuit 10, when the third to fifth transistors M13, M14, and M15 become conductive in the first period T1 as the initialization period, the capacitor 12 is charged and the first transistor M11 becomes conductive. Thereby, an electric current is flown to the light emitting element 11 from the first power supply line P1 via the first transistor M11. Therefore, even in a case where black display is continued, hysteresis of the transistor characteristic of the first transistor M11 can be overcome through having the electric current flown to the first transistor M11 in the initialization period. Thus, there is no delay generated when switching to white display, so that image retention can be prevented.

Figure 2:
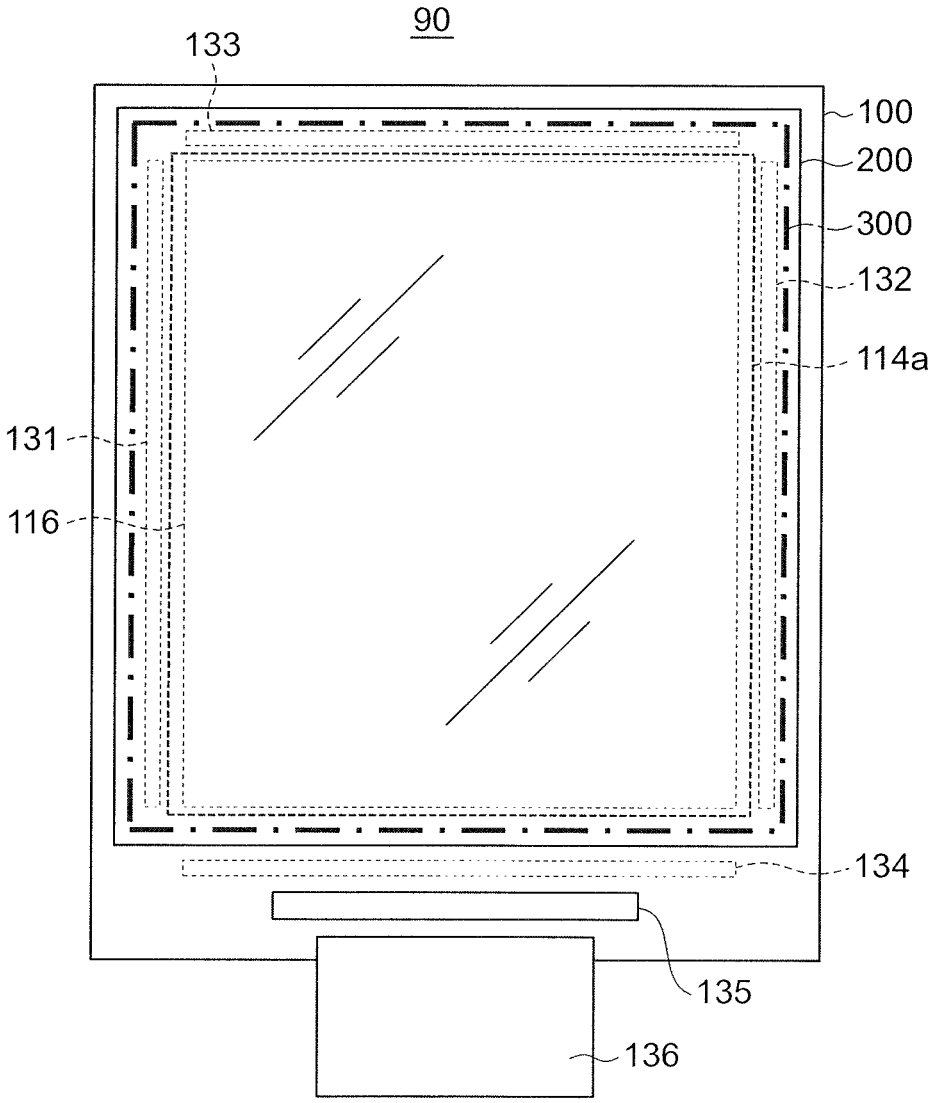
FIG. 2 is a plan view showing a display device that is provided with the pixel circuit of the first exemplary embodiment.

FIG. 2 is a plan view showing a display device provided with the pixel circuit of the first exemplary embodiment. Hereinafter, explanations will be provided by referring to the drawing.

A display device 90 according to the first exemplary embodiment is AMOLED. Roughly speaking, the display device 90 is constituted with: a TFT substrate 100 in which a plurality of pixel circuits (see FIG. 1A) including light emitting elements are arranged in matrix; a sealing glass substrate 200 which seals the light emitting elements; a glass frit seal part 300 which joins the TFT substrate 100 and the sealing glass substrate 200; and the like. Further, disposed in the periphery of a cathode electrode forming area 114*a* on the outer side of an active matrix part 116 of the TFT substrate 100 are: a scanning driver 131 which drives scan lines (each of control lines) of the TFT substrate 100; an emission control driver 132 which controls the light emission period of each pixel; a data line ESD (Electro-Static-Discharge) protection circuit 133 which prevents damages caused by electrostatic discharge; a de-multiplexer 134 which returns high-transfer rate streams to a plurality of streams of the original low transfer rate; a data driver IC 135 which drives the data lines; and the like. The data driver IC 135 is mounted to the TFT substrate 100 by using an anisotropic conductive film. The TFT substrate 100 is connected to an outer apparatus via an FPC (Flexible Printed Circuit) 136. The display device shown in FIG. 2 is merely an example of the display device according to the first exemplary embodiment, and its shape and structures can be changed as appropriate.

The corresponding relation between FIG. 1A and FIG. 2 is as follows. The first control line S1 in FIG. 1A is connected to the scanning driver 131 in FIG. 2. The second control line S2 in FIG. 1A is connected to the emission control driver 132 in FIG. 2. The data line D1 in FIG. 1A is connected to the data driver IC 135 via the de-multiplexer 134 in FIG. 2. The first to third power supply lines P1 to P3 in FIG. 1A are connected to an external power source via the EPC 136 in FIG. 2.

Figure 3:
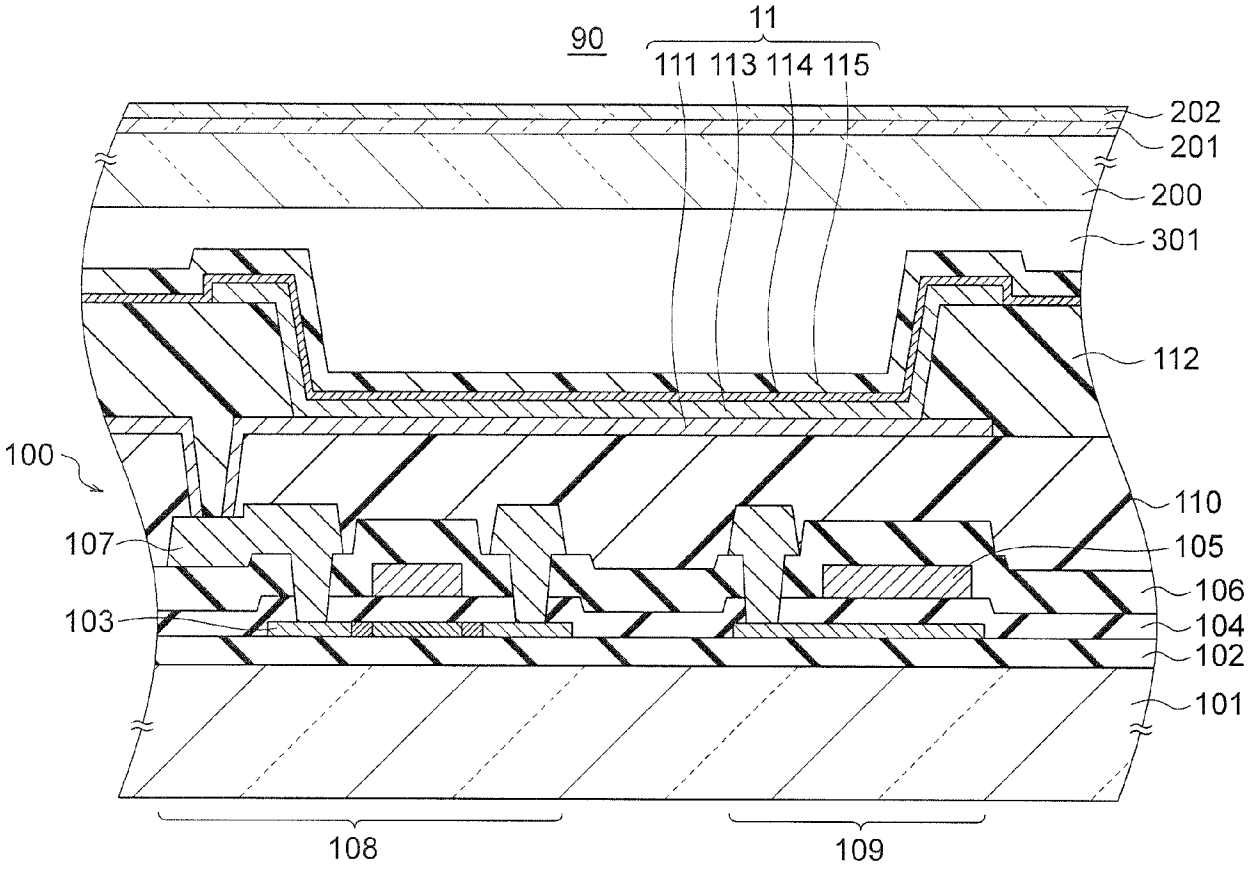
FIG. 3 is a fragmentary enlarged sectional view of FIG. 2.

FIG. 3 is a fragmentary enlarged sectional view of FIG. 2. Hereinafter, explanations will be provided by referring to the drawing.

The TFT substrate 100 is constituted with: a polysilicon layer 103 formed with low temperature polycrystalline silicon (LTPS) and the like formed on a glass substrate 101 via a base insulating film 102; a first metal layer 105 (gate electrode and capacitor electrode) formed via a gate insulating film 104; a second metal layer 107 (data line, power supply line, source and drain electrodes, and contact part) connected to the polysilicon layer 103 via an opening formed in an interlayer insulating film 106; and the light emitting element 11 (anode electrode 111, organic EL layer 113, cathode electrode 114, and cap layer 115) formed in the recessed part of an element separating film 112 via a flattening film 110.

The polysilicon layer 103 in the TFT region 108 is in an Lightly Doped Drain (LDD) structure in which a p+ layer, a p− layer, an i layer, a p− layer, and a p+ layer are formed in this order from the left side. The polysilicon layer 103 in the capacitor region 109 is a p+ layer.

Dry air 301 is sealed between the light emitting element 11 and the sealing glass substrate 200. Through sealing those elements and glass substrate by the glass frit seal part 300 (FIG. 2), the display device 90 is formed. The light emitting element 11 is of a top emission structure, in which the light emitting element 11 and the sealing glass substrate 200 are set with a prescribed space therebetween, and a λ/4 phase difference plate 201 and a polarization plate 202 are formed on the light exit side of the sealing glass substrate 200 so that the reflection light of an incident light from the outer side can be suppressed.

While FIG. 3 shows the top emission structure with which each irradiated light of the light emitting element 11 is irradiated towards the outside via the sealing glass substrate 200, it is also possible to employ a bottom emission structure with which the light is irradiated towards the outside via the glass substrate 101.

Further, while all the transistors are of p-channel type in the first exemplary embodiment, the transistors are not limited to that type. A part of or the whole transistors may be of an n-channel type. In a case where the driving transistor of the OLED is the n-channel type, the conduction direction of the OLED is reversed so that the cathode terminal of the OLED is connected to the drain terminal. A semiconductor material for forming the transistor is not limited to silicon such as LTPS. An oxide semiconductor such as Indium Gallium Zinc Oxide (IGZO) or an organic semiconductor may be used as well.

Figure 4B:
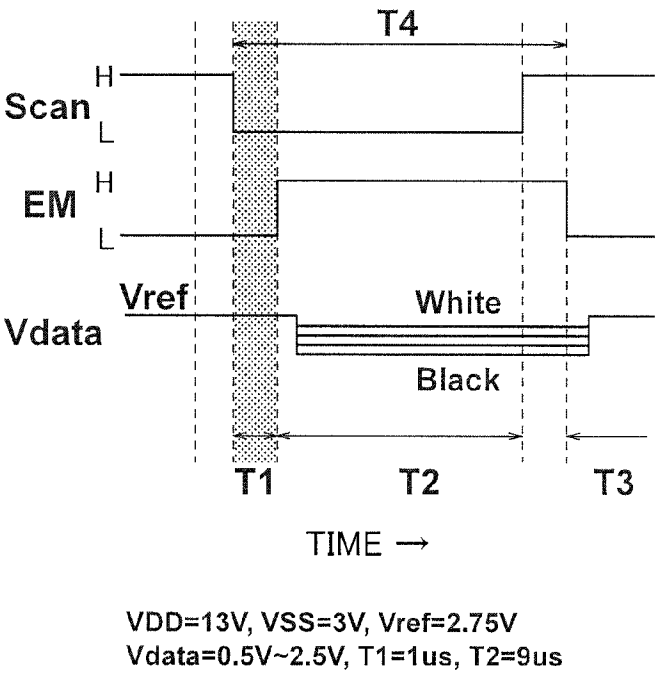
FIG. 4B is a timing chart of the highlighted first period.
Figure 4A:
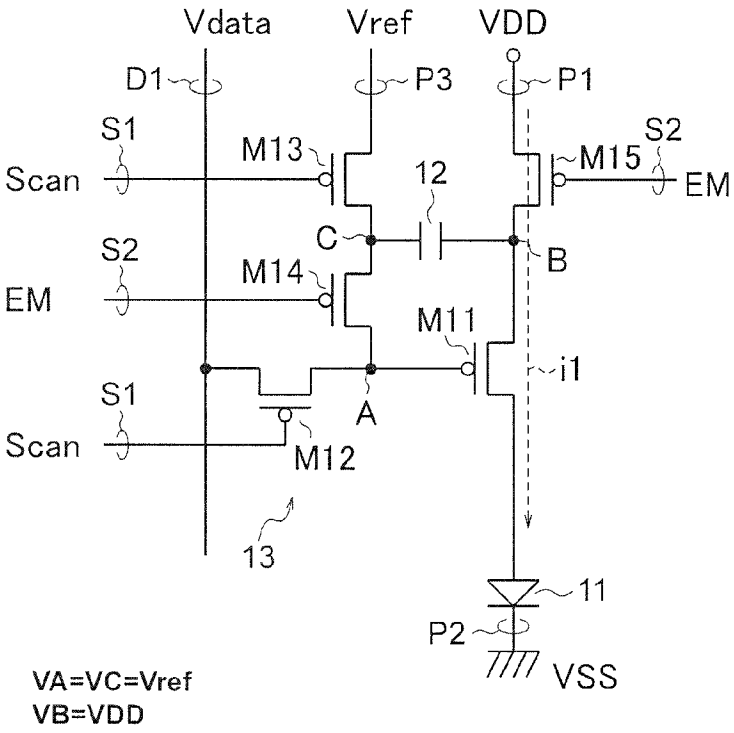
FIG. 4A is a circuit diagram of a first period showing operations (driving method) of the pixel circuit of the first exemplary embodiment.
Figure 5B:
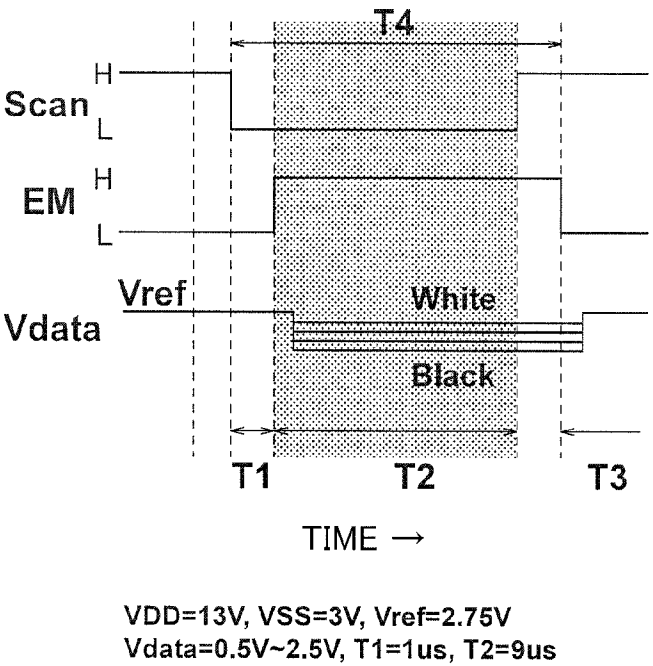
FIG. 5B is a timing chart of the highlighted second period.
Figure 5A:
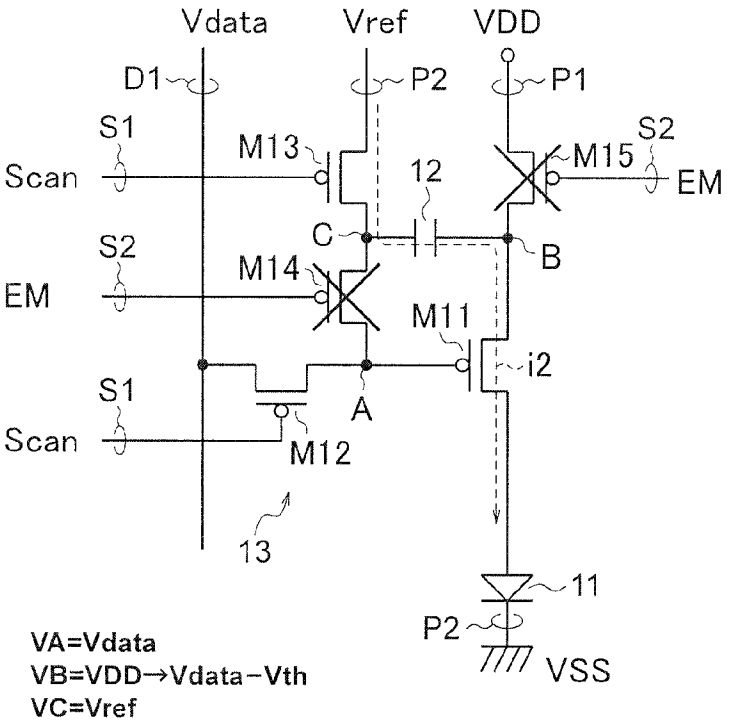
FIG. 5A is a circuit diagram of a second period showing operations (driving method) of the pixel circuit of the first exemplary embodiment.
Figure 6A:
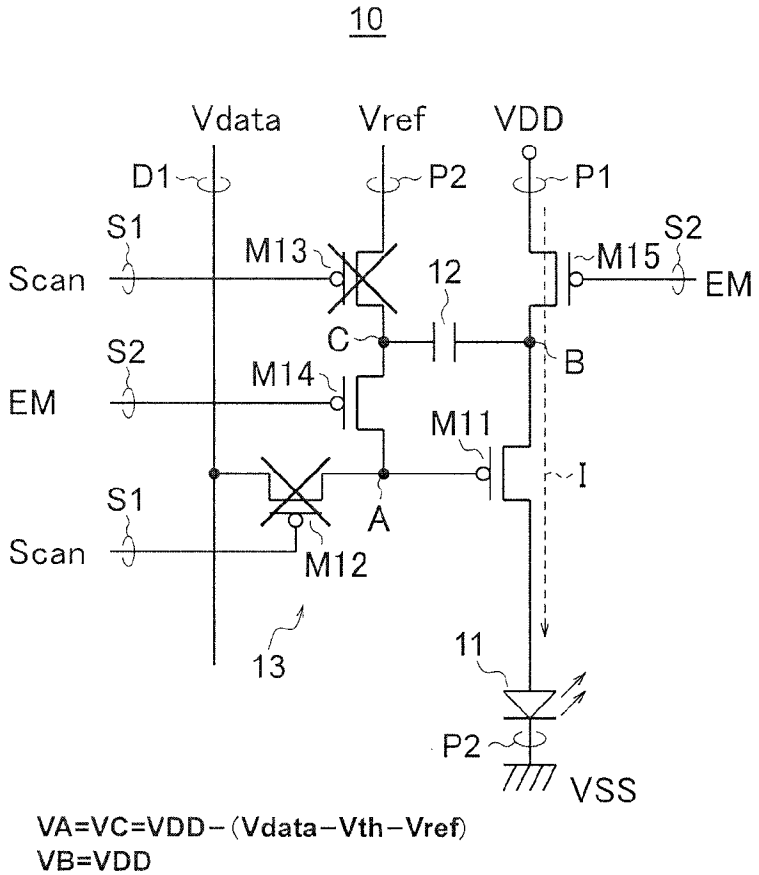
FIG. 6A is a circuit diagram of a third period showing operations (driving method) of the pixel circuit of the first exemplary embodiment.
Figure 6B:
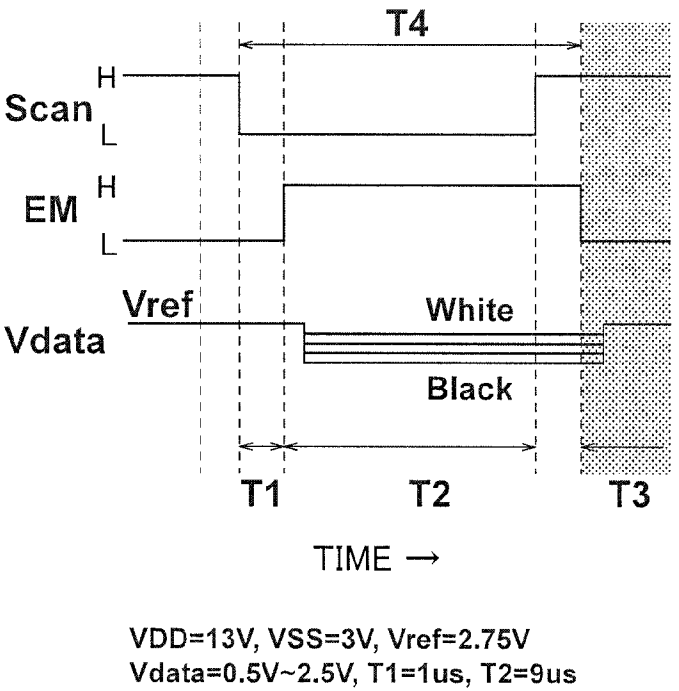
FIG. 6B is a timing chart of the highlighted third period.

Figures from 4A to 6B show operations (driving method) of the pixel circuit according to the first exemplary embodiment. FIG. 4A, FIG. 5A, and FIG. 6A are circuit diagrams of first to third periods. Further, FIG. 4B, FIG. 5B, and FIG. 6B are timing charts of the first to third periods. Note that a two-dot chain line showing a reference number "13" in FIG. 1A is replaced with an arrow for showing a reference number "13" in FIGS. 4A, 5A, and 6A in order to be able better to show the current path. Hereinafter, the operations (driving method) of the pixel circuit according to the first exemplary embodiment will be described by adding FIG. 4A to FIG. 6B to FIG. 1A and FIG. 1B.

The transistors marked with sign of "X" among the transistors shown in FIG. 4A, FIG. 5A, and FIG. 6A are in an off state. The pixel circuit is driven by the driving method of the pixel circuit, so that it is expressed as the operations (driving method) of the pixel circuit.

In the followings, the outline of the driving method of the pixel circuit 10 will be explained by referring to FIG. 1A and FIG. 1B. The driving method of the pixel circuit 10 includes the following first to third periods T1 to T3. In this case, the switch part 13 operates as follows.

First Period T1: The voltage held to the capacitor 12 is initialized, and a prescribed voltage is applied to the first transistor M11 to temporarily turn on the first transistor M11.

Second Period T2: The voltage containing the threshold voltage Vth and the data voltage Vdata of the first transistor M11 is held to the capacitor 12.

Third Period T3: Through applying the voltage held to the capacitor 12 to the first transistor M11, the first transistor M11 supplies the electric current according to the voltage applied by the switch part 13 to the light emitting element 11.

Next, each period will be described in more detail. The first period T1 is the initialization period, the second period T2 is a threshold value detecting and data storing period, and the third period T3 is a driving period. The first period T1 and the second period T2 are included in the non-emission period T4. Each transistor is of a p-channel type, so that it is turned on when each control signal is L (low) level and turned off when each control signal is H (high) level. In general, the threshold voltage Vth of the driving transistor is Vth<0 when it is of a p-channel type and Vth>0 when it is of an n-channel type.

In the first period T1 shown in FIG. 4A and FIG. 4B, the second to fifth transistors M12 to M15 are set on. The reference voltage Vref is supplied from the data line D1.

Thereby, the potential VB of the source terminal (node B) of the first transistor M11 is fixed to VDD, and the potential VA of the gate terminal (node A) is fixed to Vref, respectively. Thus, a constant voltage Vref−VDD is applied between the gate and the source of the first transistor M11, so that the first transistor is turned on and an electric current i1 is flown to the light emitting element 11 from the power supply line P1. At this time, the potential VC of the node C becomes also Vref, so that the potential between the both terminals of the capacitor 12 is initialized with the potential difference of VDD−Vref.

Note here that the electric current i1 flown in the first transistor M11 is given by following expressions.

$$VA = VC = Vref$$

$$VB = VDD$$

$$\therefore i1 = (1/2\beta)((VA - VB) - Vth)^2$$

$$= (1/2\beta)(Vref - VDD - Vth)^2$$

As shown in the above expressions, the electric current "i1" is an enough value that is sufficient to be about the level of white display. Thus, initialization of the hysteresis characteristic of the first transistor M11 can be prevented. This is the image retention preventing effect of the pixel circuit 10.

Note that β in the above expressions is a constant determined according to the structure and the material of the first transistor M11. That is, for the first transistor M11, β is given by a following expression where the gate capacitance is Cox, the channel width is W, and the channel length is L.

$$\beta = Cox(W/L)$$

In the second period T2 shown in FIG. 5A and FIG. 5B, the second transistor M12 and the third transistor M13 are turned on while the fourth transistor M14 and the fifth transistor M15 are turned off. The data voltage Vdata is supplied from the data line D1.

Thereby, the potential of the gate terminal (node A) of the first transistor M11 is fixed to the data voltage Vdata so that the first transistor M11 is turned on in the beginning of the second period. In the meantime, as electric current i2 between the source and the drain decreases the electric charge of the capacitor 12, the potential of the source terminal (node B) of the first transistor M11 decreases from VDD to the low voltage. Then, when the potential of the source terminal (node B) becomes Vdata−Vth, the first transistor M11 is turned off and the potential difference Vdata−Vth−Vref is held between the both terminals of the capacitor 12.

That is, the potential VA of the node A, the potential VB of the node B, and the potential VC of the node C can be expressed as follows, and the voltage containing the threshold voltage Vth and the data voltage Vdata of the first transistor M11 is held to the capacitor 12. As described, in the first exemplary embodiment, a source follower type threshold voltage detecting module is used.

$$VA = V\text{data}$$

$$VB = VDD \rightarrow V\text{data} - Vth$$

$$VC = V\text{ref}$$

In the third period T3 shown in FIG. 6A and FIG. 6B, the second transistor M12 and the third transistor M13 are turned off while the fourth transistor M14 and the fifth transistor M15 are turned on. The reference voltage Vref is supplied from the data line D1.

Thereby, the potential difference Vdata−Vth−Vref between the both terminals of the capacitor 12 is applied between the gate and source of the first transistor M11, and the electric current I corresponding thereto is flown to the light emitting element 11 so that the light emitting element 11 radiates light.

At this time, the potential VB of the node B becomes a first power supply voltage VDD via the fifth transistor M15. In the meantime, the potential VA of the node A comes to take a value acquired by subtracting the potential difference between the both terminals of the capacitor 12 from the first power supply voltage VDD. Thus, the electric current I in the first transistor M11 is given by following expressions.

$$VA = VC = VDD - (Vdata - Vth - Vref)$$

$$VB = VDD$$

$$\begin{aligned} \therefore I &= (1/2\beta)((VA - VB) - Vth)^2 \\ &= (1/2\beta)((VDD - (Vdata - Vth - Vref)) - VDD) - Vth)^2 \\ &= (1/2\beta)(Vref - Vdata)^2 \end{aligned}$$

From the above expressions, the electric current "I" does not contain the threshold voltage Vth, so that it is not influenced by variation and fluctuation of the threshold voltage Vth. This is the threshold voltage Vth variation compensating effect of the pixel circuit 10.

It is to be noted that the relations of VDD>Vref and VDD>VSS apply in this case. For example, VDD=13 V, VSS=3 V, Vref=2.75 V, Vdata=0.5 V to 2.5 V, T1=1 μs, and T2=9 μs. Note here that the first period T1 is shorter than the second period T2. In the first period T1, the capacitor 12 is charged by a relatively large electric current of the fourth transistor M14 and the fifth transistor M15 operating as the switches. Therefore, it takes only a short time. In the meantime, in the second period T2, the capacitor 12 is discharged by a small electric current in the vicinity of the threshold voltage Vth of the first transistor M11 operating as the driving transistor. Thus, it takes a longer time. Further, the change in the holding voltage caused by switching feedthrough is not taken into consideration in each of the above-described expressions for simplifying the explanations. It is the same for each of following expressions.

As an exemplary advantage according to the invention, the present invention makes it possible to prevent image retention through applying a constant voltage to the driving transistor before having the voltage containing the threshold voltage and the data voltage held to the capacitor part.

Second Exemplary Embodiment

Figure 7A:
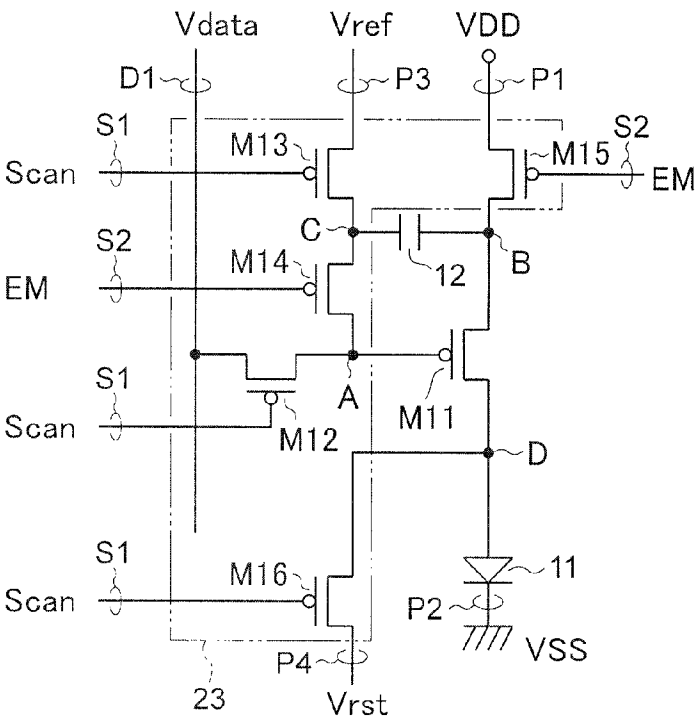
FIG. 7A is a circuit diagram showing the structure of a pixel circuit according to a second exemplary embodiment.
Figure 7B:
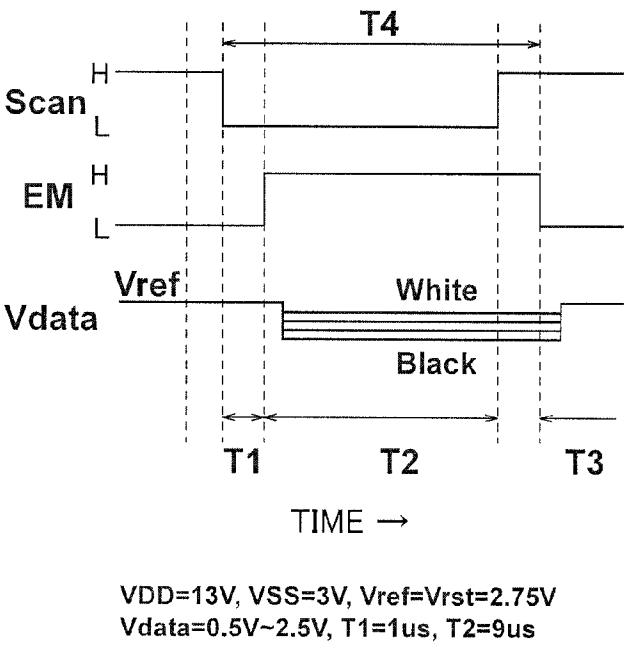
FIG. 7B is a timing chart showing operations of the pixel circuit of the second exemplary embodiment.

FIG. 7A is a circuit diagram showing the structure of a pixel circuit according to a second exemplary embodiment, and FIG. 7B is a timing chart showing operations of the pixel circuit of the second exemplary embodiment. Explanations will be provided hereinafter by referring to those drawings.

A pixel circuit 20 of the second exemplary embodiment is different from that of the first exemplary embodiment in respect that a switch part 23 includes a current detour transistor (M16). The current detour transistor (M16) makes the electric current supplied from the driving transistor (M11) detour without flowing through the light emitting element 11.

Further, the switch part 13 turns on the driving transistor (M11) and the current detour transistor (M16) before having the voltage containing the threshold voltage Vth and the data voltage Vdata of the driving transistor (M11) held to the capacitor part (12).

In more detail, the switch part 23 turns on the current detour transistor (M16) in the first period T1 and the second period T2, and turns it off in the third period T3. The sixth transistor M16 corresponding to the current detour transistor (M16) includes: a first terminal which is electrically connected to the first terminal of the light emitting element 11; a second terminal which is electrically connected to the fourth power supply line P4; and a control terminal which is electrically connected to the first control line S1. The fourth power supply line P4 supplies a reset voltage Vrst.

The pixel circuit 20 includes the current detour transistor (M16) which makes the current supplied from the driving transistor (M11) detour without flowing through the light emitting element 11. Thus, through turning on the current detour transistor (M16) in the non-emission period T4, contrast deterioration caused by leaked light emission in the non-emission period T4 can be prevented.

Further, with the pixel circuit 20, the electric current can be flown to the driving transistor (M11) securely before supplying the electric current to the light emitting element 11 by turning on the driving transistor (M11) and the current detour transistor (M16) before having the voltage containing the threshold voltage Vth and the data voltage Vdata held to the capacitor 12. Thus, initialization of the hysteresis characteristic of the driving transistor (M11) can be prevented, thereby making it possible to prevent image retention without causing contrast deterioration.

Figure 8A:
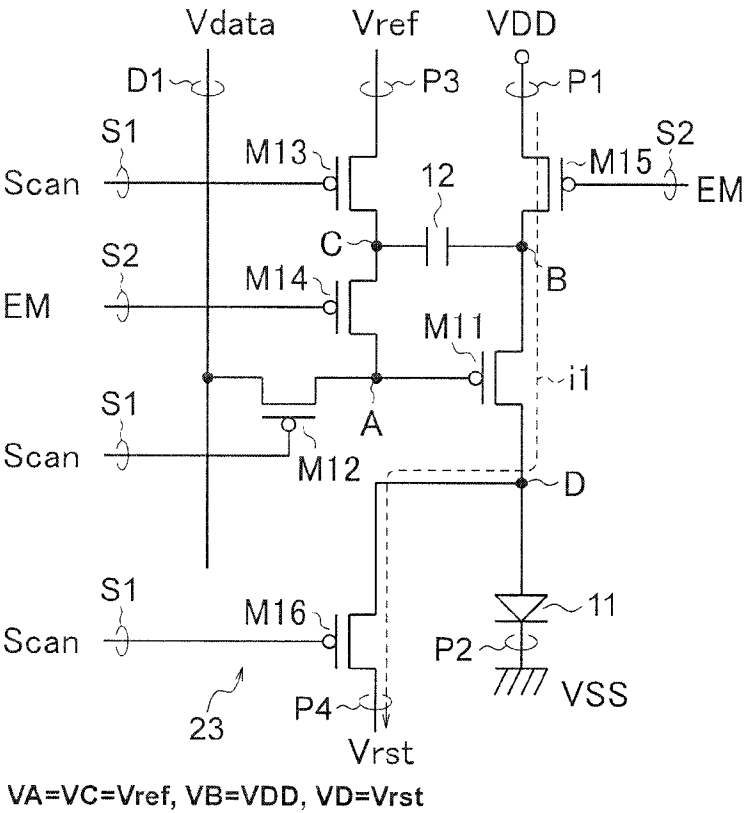
FIG. 8A is a circuit diagram of a first period showing operations (driving method) of the pixel circuit of the second exemplary embodiment.
Figure 8B:
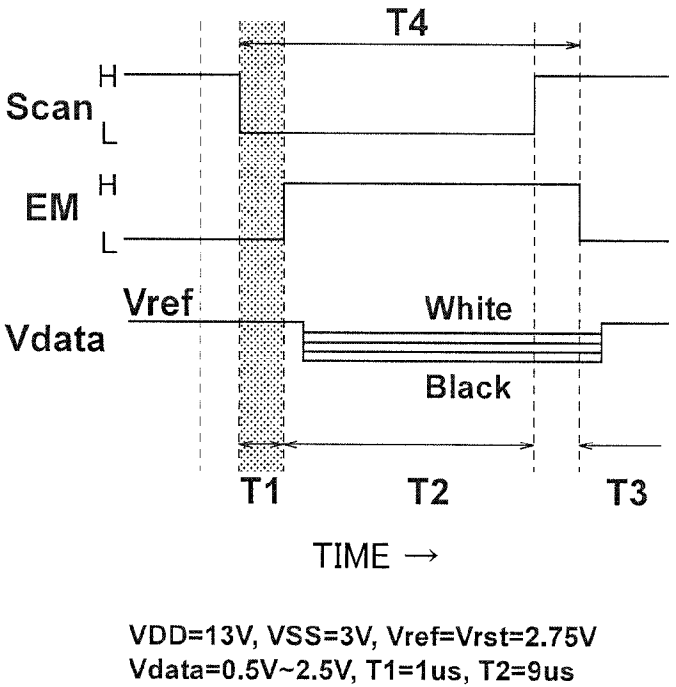
FIG. 8B is a timing chart of the highlighted first period.
Figure 9A:
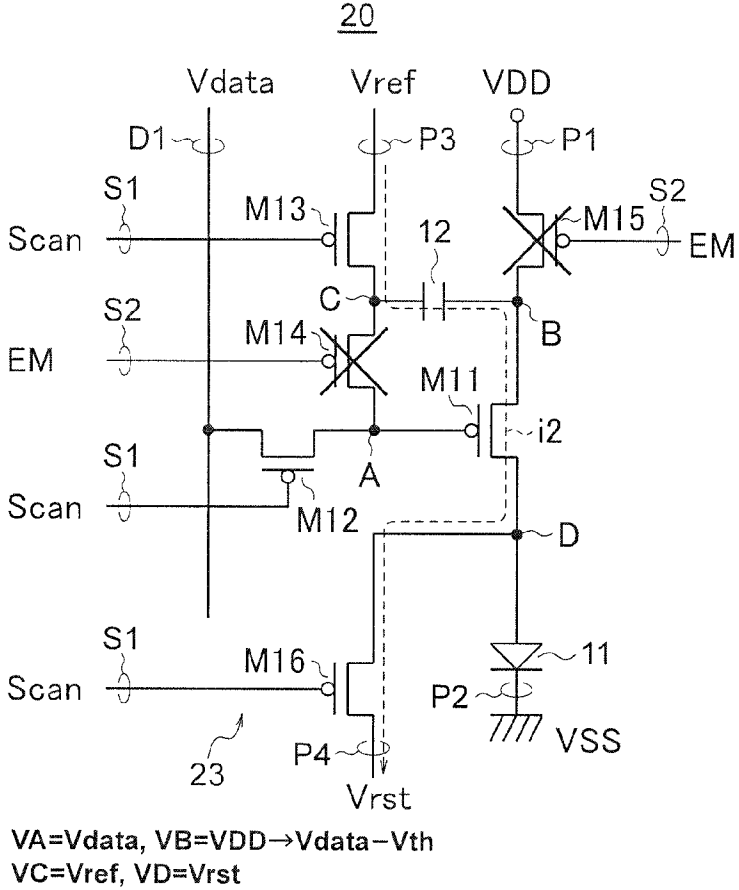
FIG. 9A is a circuit diagram of a second period showing operations (driving method) of the pixel circuit of the second exemplary embodiment.
Figure 9B:
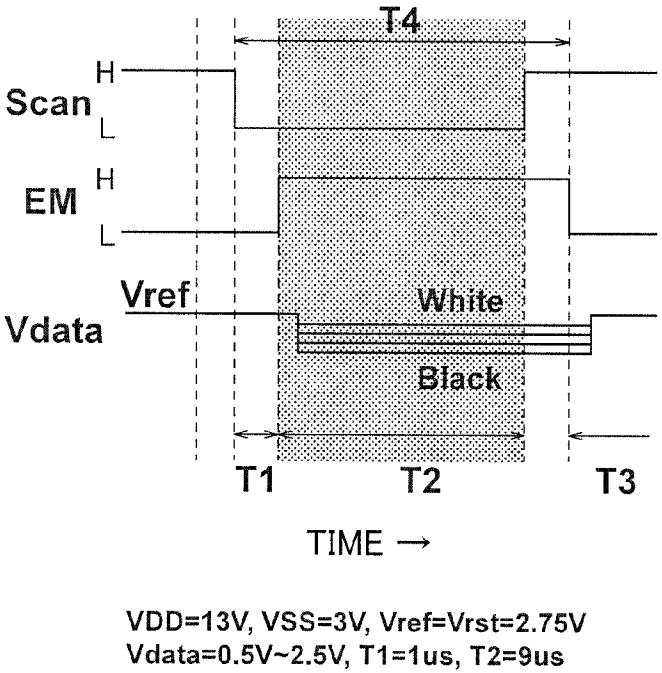
FIG. 9B is a timing chart of the highlighted second period.
Figure 10B:
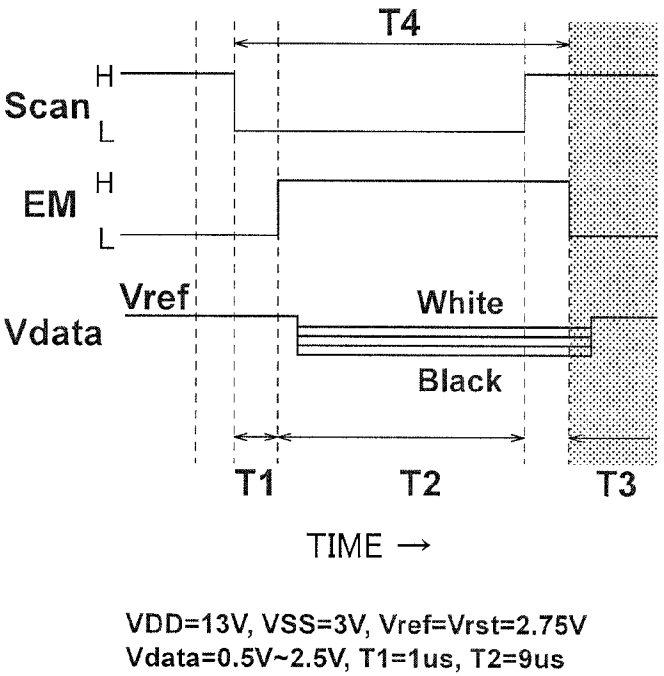
FIG. 10B is a timing chart of the highlighted third period.

FIGS. 8A to 10B show operations (driving method) of the pixel circuit according to the second exemplary embodiment. FIG. 8A, FIG. 9A, and FIG. 10A are circuit diagrams of first to third periods. Further, FIG. 8B, FIG. 9B, and FIG. 10B are timing charts of the first to third periods. Note that a two-dot chain line showing a reference number "23" in FIG. 7A is replaced with an arrow for showing a reference number "23" in FIGS. 8A, 9A, and 10A in order to be able better to show the current path. Hereinafter, the operations (driving method) of the pixel circuit according to the second exemplary embodiment will be described by adding FIG. 8A to FIG. 10B to FIG. 7A and FIG. 7B.

In the followings, the outline of the driving method of the pixel circuit 20 will be explained by referring to FIG. 7A and FIG. 7B. The driving method of the pixel circuit 20 includes the following first to third periods T1 to T3. In this case, the switch part 23 operates as follows.

First Period T1: The voltage held to the capacitor 12 is initialized, and a constant voltage is applied to the first transistor M11 to temporarily set on the first transistor M11. At this time, the sixth transistor M16 is turned on to guide the electric current supplied from the first transistor M11 to the fourth power supply line P4 by detouring the light emitting element 11.

Second Period T2: The voltage containing the threshold voltage Vth and the data voltage Vdata of the first transistor M11 is held to the capacitor 12. At this time, the sixth transistor M16 is turned on, so that the electric current supplied from the first transistor M11 detours the light emitting element 11 and flows to the fourth power supply line P4.

Third Period T3: Through applying the voltage held to the capacitor 12 to the first transistor M11, the first transistor M11 supplies the electric current according to the voltage applied by the switch part 13 to the light emitting element 11.

Next, each period will be described in more detail. The first period T1 is the initialization period, the second period T2 is a threshold value detecting and data storing period, and the third period T3 is a driving period. Each transistor is of a p-channel type, so that it is turned on when each control signal is L (low) level and turned off when each control signal is H (high) level.

In the first period T1 shown in FIG. 8A and FIG. 8B, the second to sixth transistors M12 to M16 are set on. The reference voltage Vref is supplied from the data line D1. In the first period T1, the second to sixth transistors M12 to M16 are turned on. Thus, the potential VA of the node A and the potential VC of the node C are fixed to Vref, the potential VB of the node B is fixed to VDD, and the potential VD of the node D is fixed to Vrst, respectively. At this time, the electric current i1 for preventing image retention is flown to the sixth transistor M16 from the first transistor M11, so that it does not flow into the light emitting element 11. Therefore, leaked light emission in the first period T1 that is the non-emission period T4 does not occur.

In the second period T2 shown in FIG. 9A and FIG. 9B, the second transistor M12, the third transistor M13, and the sixth transistor M16 are turned on while the fourth transistor M14 and the fifth transistor M15 are turned off. The data voltage Vdata is supplied from the data line D1. At this time, the electric current i2 for detecting the threshold voltage Vth is flown to the sixth transistor M16 from the first transistor M11, so that it does not flow into the light emitting element 11. Therefore, leaked light emission in the second period T2 that is the non-emission period T4 does not occur.

Figure 10A:
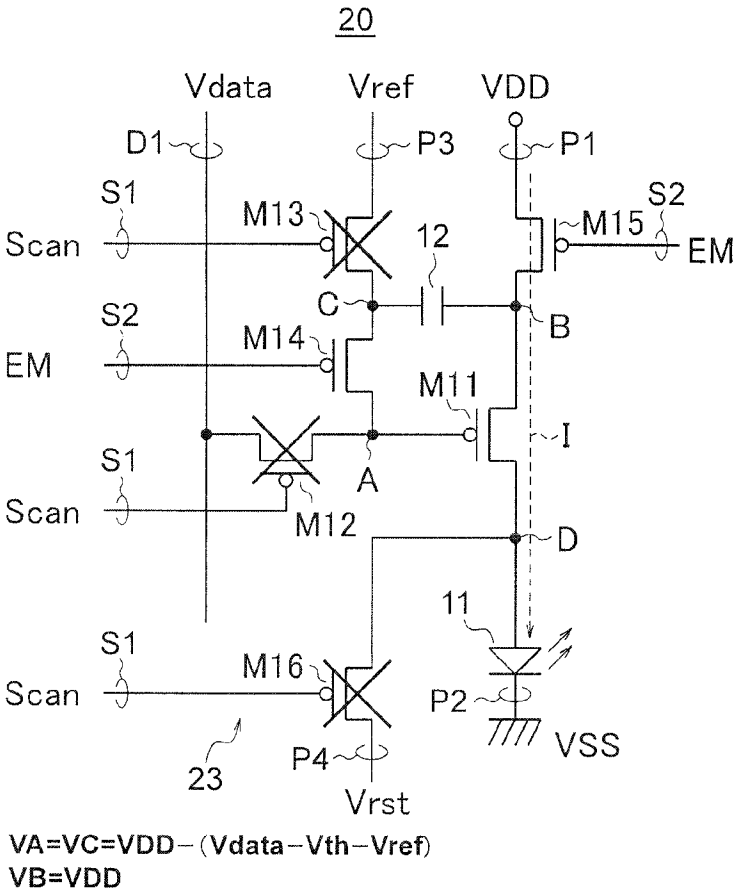
FIG. 10A is a circuit diagram of a third period showing operations (driving method) of the pixel circuit of the second exemplary embodiment.

In the third period shown in FIG. 10A and FIG. 10B, the second transistor M12, the third transistor M13, and the sixth transistor M16 are turned off while the fourth transistor M14 and the fifth transistor M15 are turned on. The reference voltage Vref is supplied from the data line D1. Thereby, the potential difference Vdata−Vth−Vref between the both terminals of the capacitor 12 is applied between the gate and source of the first transistor M11, and the electric current I corresponding thereto is flown to the light emitting element 11 so that the light emitting element 11 radiates light.

It is to be noted that the relations of VDD>Vref and VDD>VSS≥Vrst apply. For example, VDD=13 V, VSS=3 V, Vref=Vrst=2.75 V, Vdata=0.5 V to 2.5 V, T1=1 μs, and T2=9 μs.

Further, it is also possible to employ a structure in which the difference between the potential (Vrst) of the fourth power supply line P4 and the potential (VDD) of the first power supply line P1 is larger than the difference between the potential (VSS) of the second power supply line P2 and the potential (VDD) of the first power supply line P1. That is, in a case of |VDD−Vrst|>|VDD−VSS|, the electric current supplied from the first transistor M11 can be guided to the fourth power supply line P4 by detouring the light emitting element 11 more securely through turning on the sixth transistor M16.

It is also possible to employ a structure in which the difference between the potential (Vrst) of the fourth power supply line P4 and the potential (VDD) of the first power supply line P1 is larger than the value acquired by subtracting the threshold voltage Vf of the light emitting element 11 from the difference between the potential (VSS) of the second power supply line P2 and the potential (VDD) of the first power supply line P1. That is, in a case of |VDD−Vrst|>|VDD−VSS|−Vf, the electric current supplied from the first transistor M11 can be guided to the fourth power supply line P4 by detouring the light emitting element 11 more securely and the potential (Vrst) of the fourth power supply line P4 can be brought closer to the potential (VDD) of the first power supply line P1 by the amount of the threshold voltage Vf. Therefore, the power supply voltage can be decreased.

It is also possible to employ a structure in which the potential (Vrst) of the fourth power line P4 is equivalent to the potential (VSS) of the second power supply line P2. That is, in a case of Vrst=VSS, the electric current supplied from the first transistor M11 can be guided to the fourth power supply line P4 by detouring the light emitting element 11 more securely and one power supply line can be omitted.

It is also possible to employ a structure in which the potential (Vrst) of the fourth power line P4 is equivalent to the potential (Vref) of the third power supply line P3. That is, in a case of Vrst=Vref, one power supply line can be omitted.

Next, the pixel circuit 20 will be described from another viewpoint.

The pixel circuit 20 includes: the light emitting element 11; the first transistor M11 as the driving transistor whose drain terminal is connected to the first terminal (anode terminal) of the light emitting element 11; the second transistor M12 which links the data line D1 (Vdata) for supplying a programming voltage to the gate terminal (node A) of the first transistor M11 and is gate-controlled by the first control signal Scan; the capacitor 12 as a holding capacitance whose one end (node B) is connected to the source terminal of the first transistor M11; the third transistor M13 which links one end (node C) of the capacitor 12 to the third power supply line P3 (Vref) and is gate-controlled by the first control signal Scan; the fourth transistor M14 which links the end (node C) of the capacitor 12 to the gate terminal (node A) of the first transistor M11 and is gate-controlled by a second control signal EM; the fifth transistor M15 which links one end (node B) of the capacitor 12 to the first power supply line P1 (VDD) and is gate-controlled by the second control signal EM; and the sixth transistor M16 which links the first terminal (anode terminal) of the light emitting element 11 to the fourth power supply line P4 (Vrst) and is gate-controlled by the first control signal Scan.

In the pixel circuit 20, the sixth transistor M16 that connects the first terminal (anode terminal) of the light emitting element 11 to the fourth power supply line P4 (Vrst) is set to be conductive to fix the potential of the first terminal (anode terminal) of the light emitting element 11 to the fourth power supply line P4 (Vrst). At the same time, the electric current flows in the first transistor M11 when detecting the threshold voltage is flown to the sixth transistor M16. With the pixel circuit 20, through setting the potential (Vrst) of the fourth power supply line P4 to be equal to or less than the potential (VSS) of the second power supply line P2, the leaked electric current flown in the light emitting element 11 in the non-emission period T4 can be prevented. At the same time, the drain terminal of the first transistor M11 is fixed to the potential (Vrst) of the fourth power supply line P4, so that the source follower operations can be stabilized.

Other structures, operations, and effects of the pixel circuit of the second exemplary embodiment are the same as those of the pixel circuit of the first exemplary embodiment. Further, a display device provided with the pixel circuit of the second exemplary embodiment can be also achieved by replacing the pixel circuit in the display device that employs the pixel circuit of the first exemplary embodiment.

Third Exemplary Embodiment

Figure 11A:
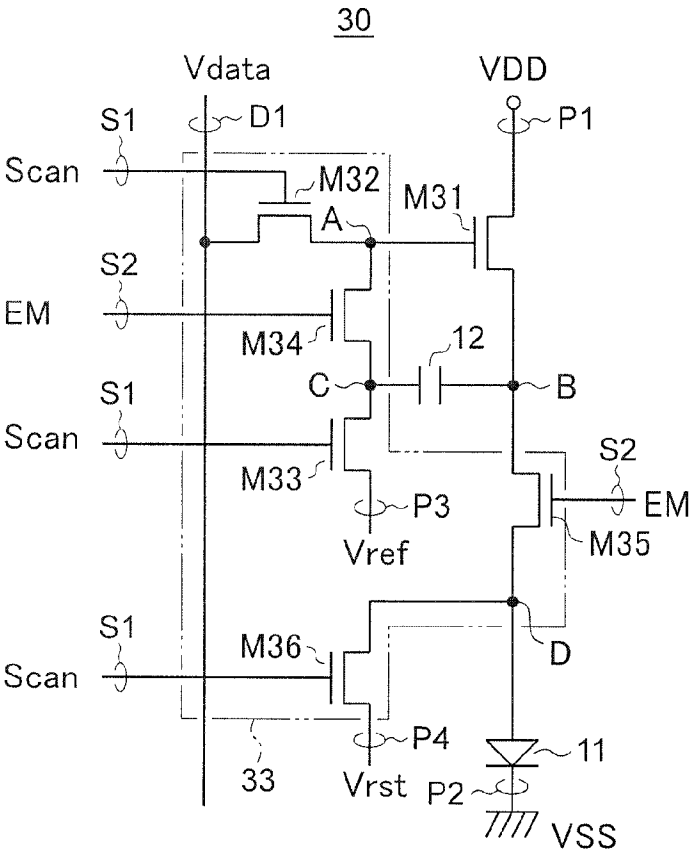
FIG. 11A is a circuit diagram showing the structure of a pixel circuit according to a third exemplary embodiment.
Figure 11B:
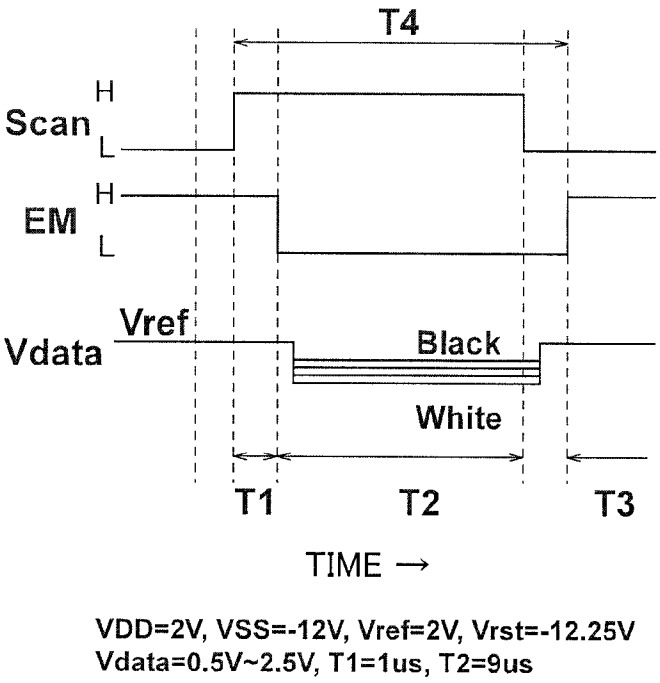
FIG. 11B is a timing chart showing operations of the pixel circuit of the third exemplary embodiment.

FIG. 11A is a circuit diagram showing the structure of a pixel circuit according to a third exemplary embodiment, and FIG. 11B is a timing chart showing operations of the pixel circuit of the third exemplary embodiment. Explanations will be provided hereinafter by referring to those drawings.

The third embodiment employs the structure in which: all the transistors of the second exemplary embodiment are replaced with the n-channel types while keeping the second terminal (cathode terminal) of the light emitting element 11 on the substrate side (VSS side); and the layout of the capacitor part (12) connected between the gate and the source as well as the accompanying transistors is changed accordingly. Therefore, the threshold voltage detecting module of the third exemplary embodiment is also a source follower type that is the same as the case of the second exemplary embodiment.

That is, the outline of a pixel circuit 30 according to the third exemplary embodiment can be described by replacing the driving transistor (M11), the data voltage transistor (M12), the reference voltage transistor (M13), the gate voltage transistor (M14), the power switching transistor (M15), the current detour transistor (M16) and the switch part 23 according to the second exemplary embodiment with a driving transistor (M31), a data voltage transistor (M32), a reference voltage transistor (M33), a gate voltage transistor (M34), a power switching transistor (M35), a current detour transistor (M36), and a switch part 33.

In more detail, the pixel circuit 30 is electrically connected to the data line D1, first and second control lines S1, S2, and first to fourth power supply lines P1 to P4, and includes the first to sixth transistors M31 to M36, the capacitor 12, and the light emitting element 11.

The light emitting element 11 includes a first terminal and a second terminal that is electrically connected to the second power supply line P2. The first transistor M31 includes a first terminal electrically connected to the first power supply line P1, a second terminal, and a control terminal. The second transistor M32 includes: a first terminal electrically connected to the data line D1; a second terminal connected to the control terminal of the first transistor M31; and a control terminal electrically connected to the first control line S1. The third transistor M33 includes: a first terminal electrically connected to the third power supply line P3; a second terminal; and a control terminal electrically connected to the first control line S1. The fourth transistor M34 includes: a first terminal electrically connected to the second terminal of the third transistor M33; a second terminal electrically connected to the control terminal of the first transistor M31; and a control terminal electrically connected to the second control line S2. The fifth transistor M35 includes: a first terminal electrically connected to the second terminal of the first transistor M31; a second terminal electrically connected to the first terminal of the light emitting element 11; and a control terminal electrically connected to the second control line S2. The sixth transistor M36 includes: a first terminal electrically connected to the first terminal of the light emitting element 11; a second terminal electrically connected to the fourth power supply line P4; and a control terminal electrically connected to the first control line S1. The capacitor 12 includes: a first terminal electrically connected to the second terminal of the third transistor M33; and a second terminal electrically connected to the second terminal of the first transistor M31.

Note here that the first transistor M31 corresponds to the above-described "driving transistor", the part consisted of the second to the sixth transistors M32 to M36 to the above-described "switch part 23", the sixth transistor M36 to the above-described "current detour transistor", and the capacitor 12 to the above-described "capacitor part", respectively. Further, the data line D1 corresponds to the above-described "data supply line", the first power supply line P1 to the above-described "power supply voltage line", and the third power supply line P3 to the above-described "reference voltage line", respectively. The first terminal, the second terminal, and the control terminal of the first transistor M31 correspond to the above-described "source terminal, drain terminal, and gate terminal of the driving transistor". The second transistor M32 corresponds to the above-described "data voltage transistor", the third transistor M33 to the above-described "reference voltage transistor", the fourth transistor M34 to the above-described "gate voltage transistor", and the fifth transistor M35 to the above-described "power switching transistor", respectively.

Figure 12B:
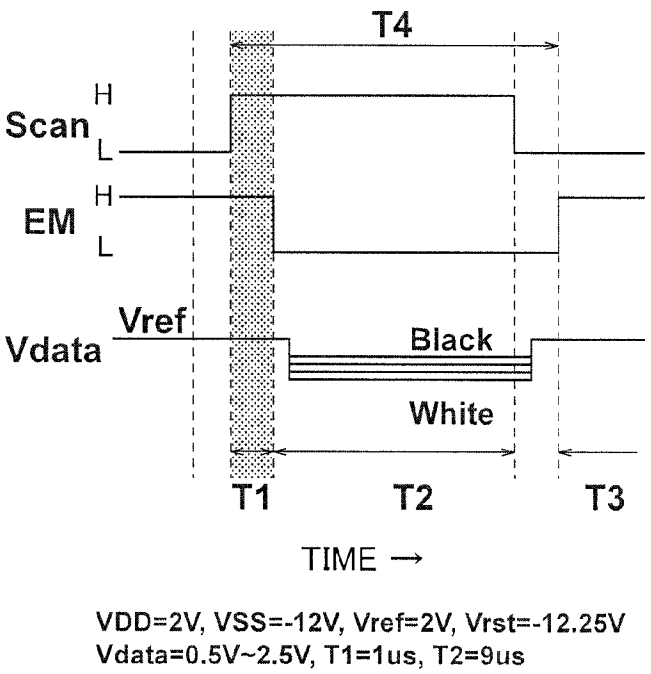
FIG. 12B is a timing chart of the highlighted first period.
Figure 12A:
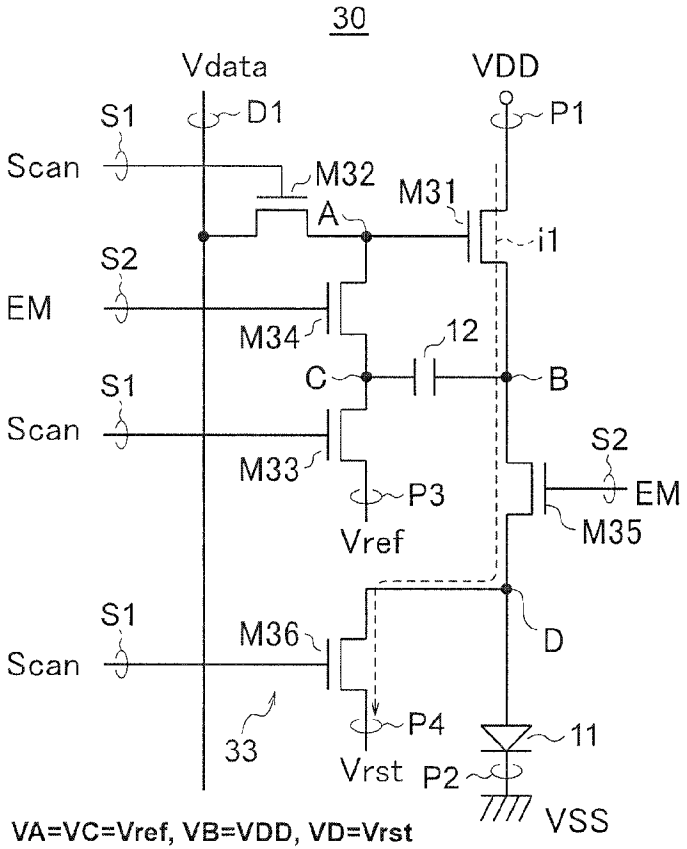
FIG. 12A is a circuit diagram of a first period showing operations (driving method) of the pixel circuit of the third exemplary embodiment.
Figure 13A:
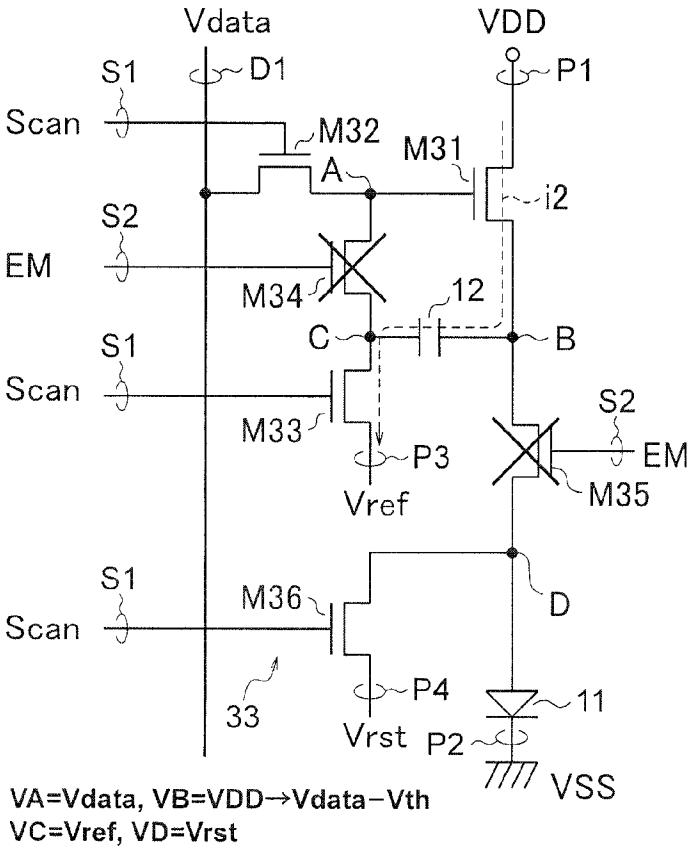
FIG. 13A is a circuit diagram of a second period showing operations (driving method) of the pixel circuit of the third exemplary embodiment.
Figure 13B:
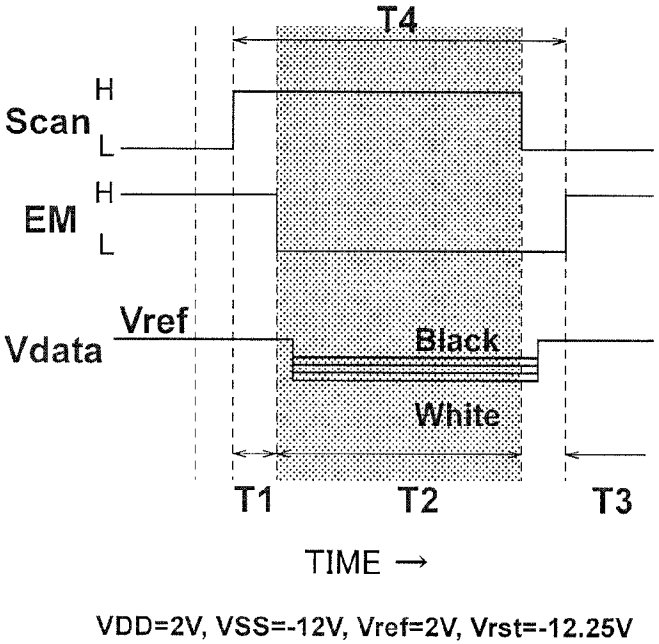
FIG. 13B is a timing chart of the highlighted second period.
Figure 14B:
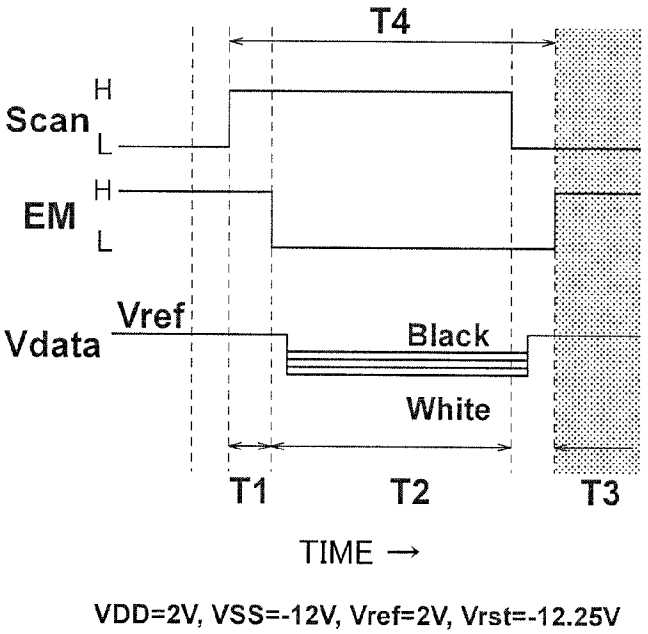
FIG. 14B is a timing chart of the highlighted third period.

FIGS. 12A to 14B show operations (driving method) of the pixel circuit according to the third exemplary embodiment. FIG. 12A, FIG. 13A, and FIG. 14A are circuit diagrams of first to third periods. Further, FIG. 12B, FIG. 13B, and FIG. 14B are timing charts of the first to third periods. Note that a two-dot chain line showing a reference number "33" in FIG. 11A is replaced with an arrow for showing a reference number "33" in FIGS. 12A, 13A, and 14A in order to be able better to show the current path. Hereinafter, the operations (driving method) of the pixel circuit according to the third exemplary embodiment will be described by adding FIG. 12A to FIG. 14B to FIG. 11A and FIG. 11B.

In the followings, the outline of the driving method of the pixel circuit 30 will be explained by referring to FIG. 11A and FIG. 11B. The driving method of the pixel circuit 30 includes the following first to third periods T1 to T3. In this case, the switch part 33 operates as follows.

First Period T1: The voltage held to the capacitor 12 is initialized, and a constant voltage is applied to the first transistor M31 to temporarily set on the first transistor M31. At this time, the sixth transistor M36 is turned on to guide the electric current supplied from the first transistor M31 to the fourth power supply line P4 by detouring the light emitting element 11.

Second Period T2: The voltage containing the threshold voltage Vth and the data voltage Vdata of the first transistor M31 is held to the capacitor 12.

Third Period T3: Through applying the voltage held to the capacitor 12 to the first transistor M31, the first transistor M31 supplies the electric current according to the voltage applied by the switch part 33 to the light emitting element 11.

Next, each period will be described in more detail. The first period T1 is the initialization period, the second period T2 is a threshold value detecting and data storing period, and the third period T3 is a driving period. Each transistor is of an n-channel type, so that it is turned off when each control signal is L (low) level and turned on when each control signal is H (high) level.

In the first period T1 shown in FIG. 12A and FIG. 12B, the second to sixth transistors M32 to M36 are set on. The reference voltage Vref is supplied from the data line D1. In the first period T1, the second to sixth transistors M32 to M36 are turned on. Thus, the potential VA of the node A and the potential VC of the node C are fixed to Vref, the potential VB of the node B is fixed to VDD, and the potential VD of the node D is fixed to Vrst, respectively. At this time, the electric current i1 for preventing image retention is flown to the sixth transistor M36 from the first transistor M31 via the fifth transistor M35, so that it does not flow into the light emitting element 11. Therefore, leaked light emission in the first period T1 that is the non-emission period T4 does not occur.

In the second period T2 shown in FIG. 13A and FIG. 13B, the second transistor M32, the third transistor M33, and the sixth transistor M36 are turned on while the fourth transistor M34 and the fifth transistor M35 are turned off. The data voltage Vdata is supplied from the data line D1. Thereby, the potential VA of the node A is fixed to Vdata, the potential VC of the node C is fixed to Vref, and the potential VD of the node D is fixed to Vrst, respectively. In the meantime, the potential VB of the node B starts from VDD and converges to Vdata−Vth when the first transistor M31 is turned off. At this time, the electric current i2 for detecting the threshold voltage Vth is flown to the third transistor M33 from the first transistor M31, so that it does not flow into the light emitting element 11. Therefore, leaked light emission in the second period T2 that is the non-emission period T4 does not occur.

Figure 14A:
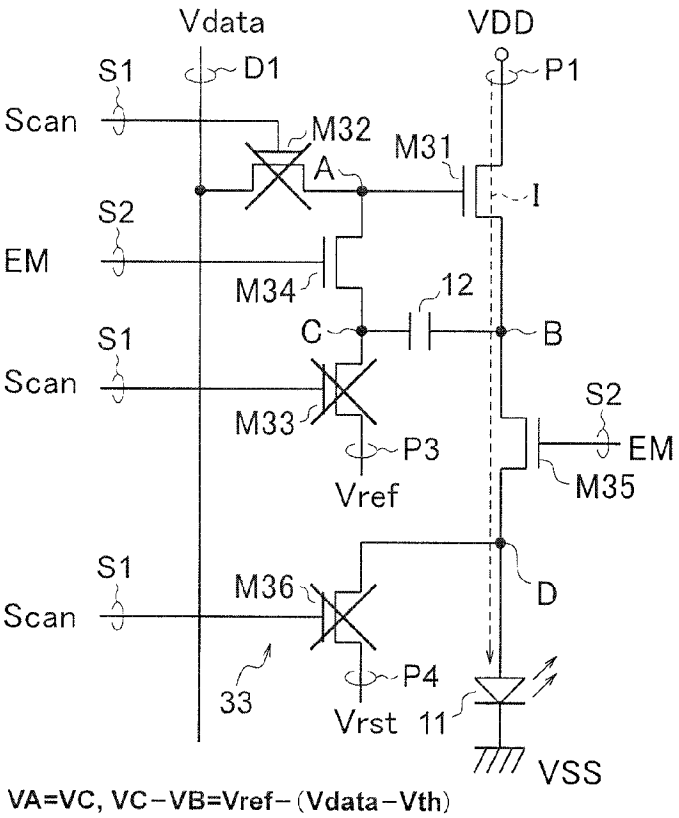
FIG. 14A is a circuit diagram of a third period showing operations (driving method) of the pixel circuit of the third exemplary embodiment.

In the third period T3 shown in FIG. 14A and FIG. 14B, the second transistor M32, the third transistor M33, and the sixth transistor M36 are turned off while the fourth transistor M34 and the fifth transistor M35 are turned on. The reference voltage Vref is supplied from the data line D1. Thereby, the potential difference Vref−(Vdata−Vth) between the both terminals of the capacitor 12 is applied between the gate and source of the first transistor M31, and the electric current I corresponding thereto is flown to the light emitting element 11 so that the light emitting element 11 radiates light.

The electric current I in this case is given by following expressions.

$$VA = VC$$

$$VC - VB = Vref - (Vdata - Vth)$$

$$\begin{aligned} \therefore I &= (1/2\beta)((VA - VB) - Vth)^2 \\ &= (1/2\beta)(Vref - (Vdata - Vth) - Vth)^2 \\ &= (1/2\beta)(Vref - Vdata)^2 \end{aligned}$$

As shown in the above expressions, the electric current "I" does not include the term of the threshold voltage Vth, so that it is not influenced by variation and fluctuation of the threshold voltage Vth.

It is to be noted that the relations of VDD>VSS≥Vrst apply. For example, VDD=2 V, VSS=−12 V, Vref=2 V, Vrst=−12.25 V, Vdata=0.5 V to 2.5 V, T1=1 μs, and T2=9 μs.

The switch part 33 may be constituted with six or more transistors. While all the transistors are of n-channel type in the third exemplary embodiment, the transistors are not limited to that type. A part of or the whole transistors may be of a p-channel type. In a case where the driving transistor of the OLED is the p-channel type, the conduction direction of the OLED is reversed so that the cathode terminal of the OLED is connected to the source terminal.

Next, the pixel circuit 30 will be described from another viewpoint.

The pixel circuit 30 includes: the light emitting element 11; the first transistor M31 as the driving transistor whose drain terminal is connected to the first power supply line P1 (VDD); the second transistor M32 which links the data line D1 (Vdata) for supplying a programming voltage to the gate terminal (node A) of the first transistor M31 and is gate-controlled by the first control signal Scan; the capacitor 12 as a holding capacitance whose one end (node B) is connected to the source terminal of the first transistor M31; the third transistor M33 which links one end (node C) of the capacitor 12 to the third power supply line P3 (Vref) and is gate-controlled by the first control signal Scan; the fourth transistor M34 which links the end (node C) of the capacitor 12 to the gate terminal (node A) of the first transistor M31 and is gate-controlled by a second control signal EM; the fifth transistor M35 which links one end (node B) of the capacitor 12 to the first terminal (anode terminal) of the light emitting element 11 and is gate-controlled by the second control signal EM; and the sixth transistor M36 which links the first terminal (anode terminal) of the light emitting element 11 to the fourth power supply line P4 (Vrst) and is gate-controlled by the first control signal Scan.

In the pixel circuit 30, the sixth transistor M36 that connects the first terminal (anode terminal) of the light emitting element 11 to the fourth power supply line P4 (Vrst) is turned on to fix the potential of the first terminal (anode terminal) of the light emitting element 11 to the fourth power supply line P4 (Vrst). With the pixel circuit 30, through setting the potential (Vrst) of the fourth power supply line P4 to be equal to or less than the potential (VSS) of the second power supply line P2, the leaked electric current flown in the light emitting element 11 in the non-emission period T4 can be prevented.

Other structures, operations, and effects of the pixel circuit of the third exemplary embodiment are the same as those of the pixel circuits of the first and second exemplary embodiments. Further, a display device provided with the pixel circuit of the third exemplary embodiment can be also achieved by replacing the pixel circuit in the display device that employs the pixel circuit of the first exemplary embodiment.

Fourth Exemplary Embodiment

Figure 15B:
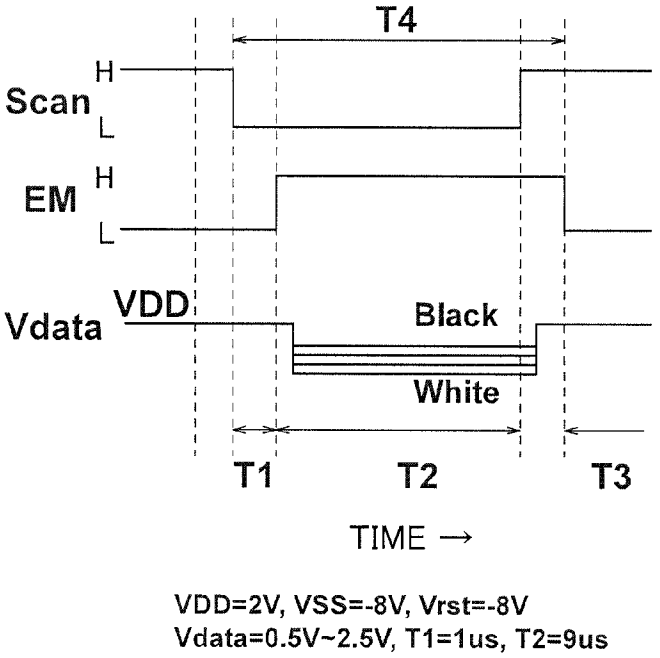
FIG. 15B is a timing chart showing operations of the pixel circuit of the fourth exemplary embodiment.
Figure 15A:
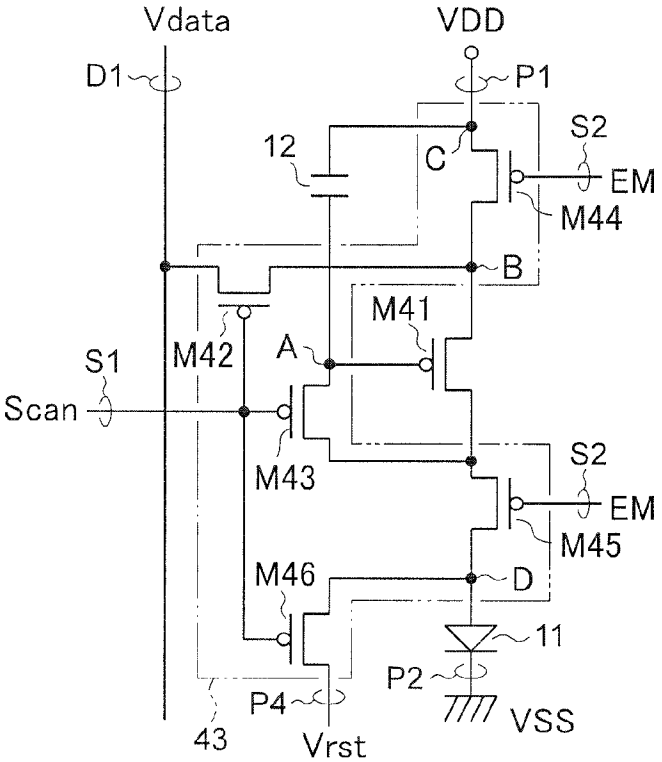
FIG. 15A is a circuit diagram showing the structure of a pixel circuit according to a fourth exemplary embodiment.

FIG. 15A is a circuit diagram showing the structure of a pixel circuit according to a fourth exemplary embodiment, and FIG. 15B is a timing chart showing operations of the pixel circuit of the fourth exemplary embodiment. Explanations will be provided hereinafter by referring to those drawings.

While the first to third exemplary embodiments use the source follower type threshold voltage detecting module, the fourth exemplary embodiment uses a diode connection type threshold voltage detecting module that is constituted with a plurality of p-channel type transistors.

That is, a pixel circuit 40 of the fourth exemplary embodiment includes: a light emitting element 11; a driving transistor (M41) which supplies an electric current corresponding to an applied voltage to the light emitting element 11; a capacitor part (12) which holds the voltage containing the threshold voltage Vth and the data voltage Vdata of the driving transistor (M41); and a switch part 43 which has the voltage containing the threshold voltage Vth and the data voltage Vdata held to the capacitor part (12) and applies the voltage to the driving transistor (M41). Further, the switch part 43 includes a function which applies a constant voltage to the driving transistor (M41) before having the voltage containing the threshold voltage Vth and the data voltage Vdata held to the capacitor part (12).

Further, the switch part 43 includes a current detour transistor (M46) which makes the electric current supplied from the driving transistor (M41) detour without flowing through the light emitting element 11. Further, the switch part 43 turns on the driving transistor (M41) and the current detour transistor (M46) before having the voltage containing the threshold voltage Vth and the data voltage Vdata held to the capacitor part (12).

The pixel circuit 40 includes the current detour transistor (M46) which makes the current supplied from the driving transistor (M41) detour without flowing through the light emitting element 11. Thus, through turning on the current detour transistor (M46) in the non-emission period T4, contrast deterioration caused by leaked light emission in the non-emission period T4 can be prevented.

Further, with the pixel circuit 40, the electric current can be flown to the driving transistor (M41) securely before supplying the electric current to the light emitting element 11 by turning on the driving transistor (M41) and the current detour transistor (M46) before having the voltage containing the threshold voltage Vth and the data voltage Vdata held to the capacitor 12. Thus, initialization of the hysteresis characteristic of the driving transistor (M41) can be prevented, thereby making it possible to prevent image retention without causing contrast deterioration.

In more detail, the driving transistor (M41) includes a gate terminal, a source terminal, and a drain terminal, and supplies an electric current corresponding to a voltage applied between the gate terminal and the source terminal to the light emitting element 11 that is connected in series to the drain terminal and the source terminal of the driving transistor (M41). In addition to the current detour transistor (M46), the switch part 43 includes: a data voltage transistor (M42) which inputs the data voltage Vdata from the data supply line (D1); a short-circuit transistor (M43) which functions as a switch to short-circuit the gate terminal and the drain terminal of the driving transistor (M41); a gate voltage transistor (M44) which applies the voltage held to the capacitor part (12) between the gate terminal and the source terminal of the driving transistor (M41); and a power switching transistor (M45) which functions as a switch of the electric current that is flown from the power supply voltage line (P1) to the drain terminal and the source terminal of the driving transistor (M41).

Further, the switch part 43 applies a constant voltage between the gate terminal and the source terminal of the driving transistor (M41) through turning on the current detour transistor (M46), the data voltage transistor (M42), the short-circuit transistor (M43), the gate voltage transistor (M44), and the power switching transistor (M45) (the first period T1). Then, the voltage containing the threshold voltage Vth and the data voltage Vdata is held to the capacitor part (12) through turning on the current detour transistor (M46), the data voltage transistor (M42), the short-circuit transistor (M43) and turning off the gate voltage transistor (M44) and the power switching transistor (M45) (the second period T2). Then, the voltage held to the capacitor part (12) is applied between the gate terminal and the source terminal of the driving transistor (M41) through turning off the current detour transistor (M46), the data voltage transistor (M42), the short-circuit transistor (M43) and turning on the gate voltage transistor (M44) and the power switching transistor (M45) (the third period T3).

In more detail, the pixel circuit 40 is electrically connected to the data line D1, first and second control lines S1, S2, and first, second, and fourth power supply lines P1, P2, and P4, and includes the first to sixth transistors M41 to M46, the capacitor 12, and the light emitting element 11.

The light emitting element 11 includes a first terminal and a second terminal that is electrically connected to the second power supply line P2. The first transistor M41 includes a first terminal, a second terminal, and a control terminal. The second transistor M42 includes: a first terminal electrically connected to the data line D1; a second terminal connected to the first terminal of the first transistor M41; and a control terminal electrically connected to the first control line S1. The third transistor M43 includes: a first terminal electrically connected to the control terminal of the first transistor M41; a second terminal electrically connected to the second terminal of the first transistor M41; and a control terminal electrically connected to the first control line S1. The fourth transistor M44 includes: a first terminal electrically connected to the first power supply line P1; a second terminal electrically connected to the first terminal of the first transistor M41; and a control terminal electrically connected to the second control line S2. The fifth transistor M45 includes: a first terminal electrically connected to the second terminal of the first transistor M41; a second terminal electrically connected to the first terminal of the light emitting element 11; and a control terminal electrically connected to the second control line S2. The sixth transistor M46 includes: a first terminal electrically connected to the first terminal of the light emitting element 11; a second terminal electrically connected to the fourth power supply line P4; and a control terminal electrically connected to the first control line S1. The capacitor 12 includes: a first terminal electrically connected to the first power supply line P1; and a second terminal electrically connected to the control terminal of the first transistor M41.

Note here that the first transistor M41 corresponds to the above-described "driving transistor", the part consisted of the second to the sixth transistors M42 to M46 to the above-described "switch part 43", the sixth transistor M46 to the above-described "current detour transistor", and the capacitor 12 to the above-described "capacitor part", respectively. Further, the data line D1 corresponds to the above-described "data supply line", and the first power supply line P1 to the above-described "power supply voltage line", respectively. The first terminal, the second terminal, and the control terminal of the first transistor M41 correspond to the above-described "source terminal, drain terminal, and gate terminal of the driving transistor". The second transistor M42 corresponds to the above-described "data voltage transistor", the third transistor M43 to the above-described "short-circuit transistor", the fourth transistor M44 to the above-described "gate voltage transistor", and the fifth transistor M45 to the above-described "power switching transistor", respectively.

Figure 16B:
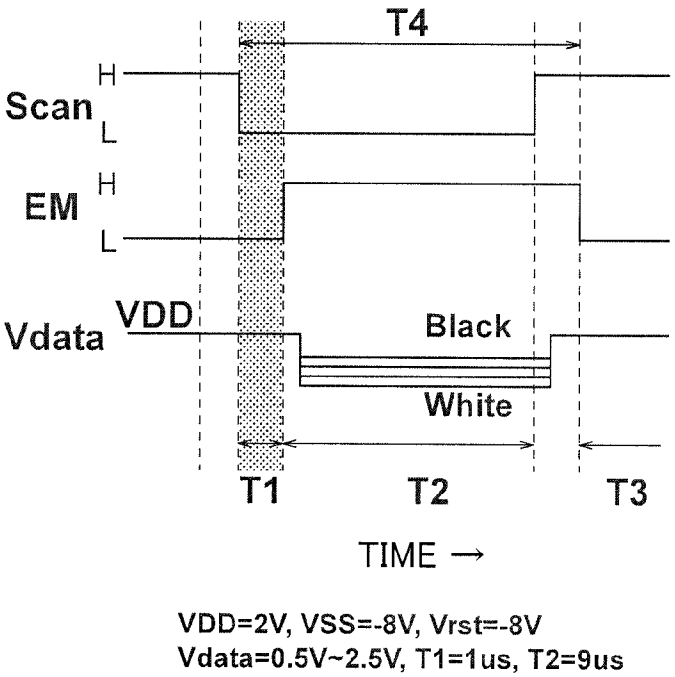
FIG. 16B is a timing chart of the highlighted first period.
Figure 16A:
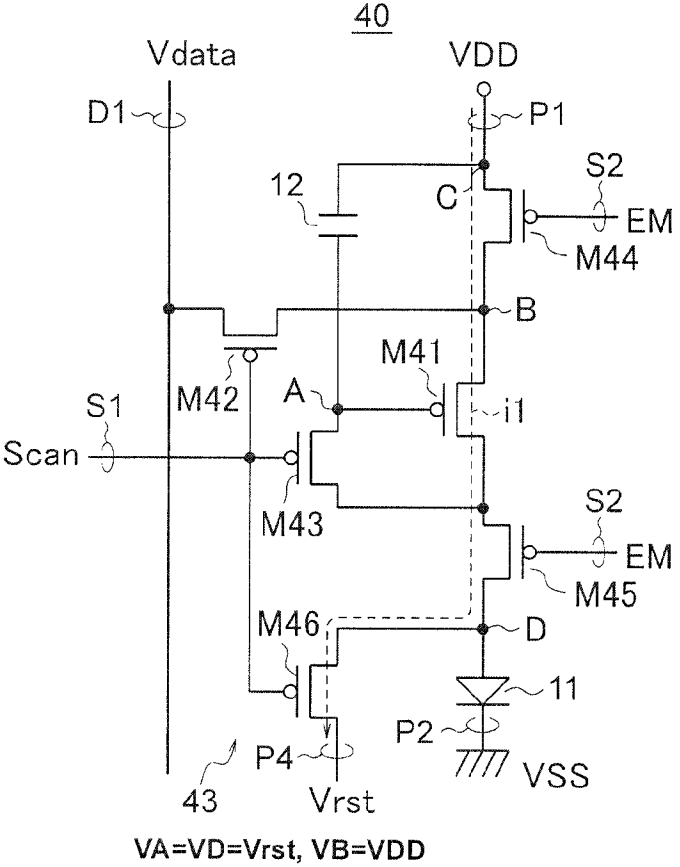
FIG. 16A is a circuit diagram of a first period showing operations (driving method) of the pixel circuit of the fourth exemplary embodiment.
Figure 17B:
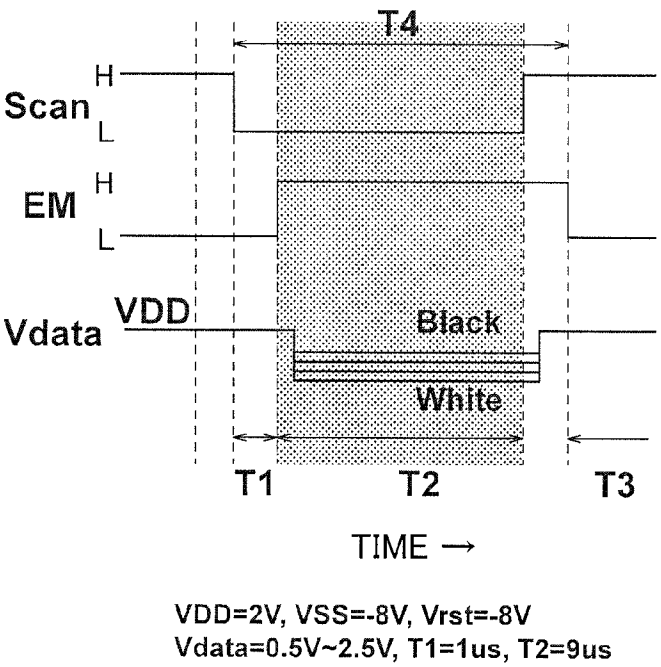
FIG. 17B is a timing chart of the highlighted second period.
Figure 17A:
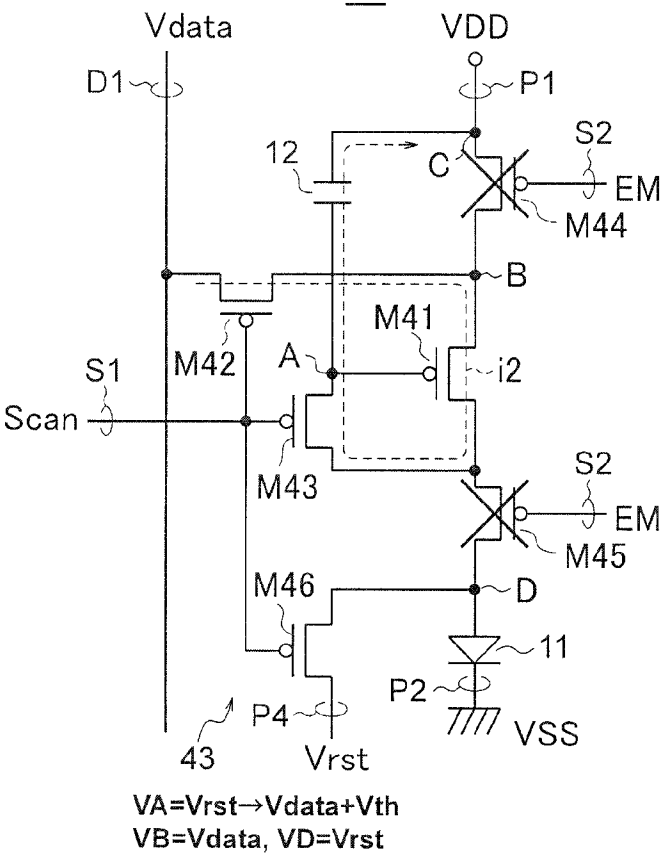
FIG. 17A is a circuit diagram of a second period showing operations (driving method) of the pixel circuit of the fourth exemplary embodiment.
Figure 18B:
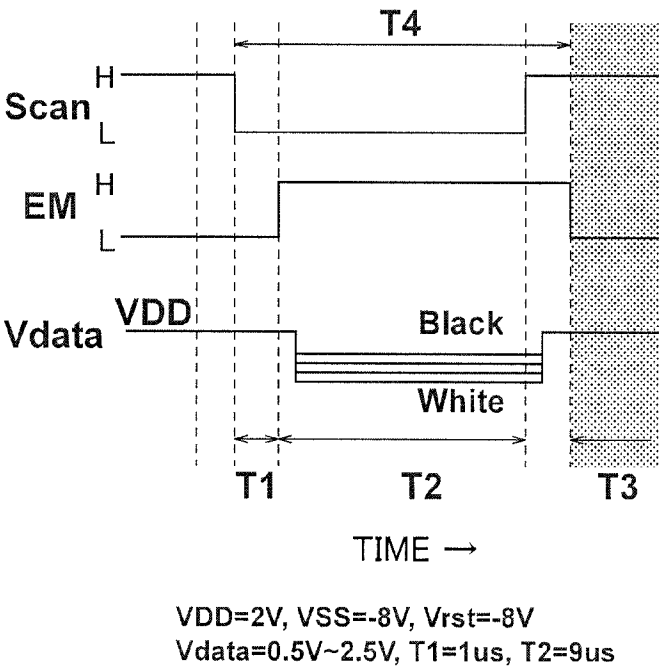
FIG. 18B is a timing chart of the highlighted third period.

FIGS. 16A to 18B show operations (driving method) of the pixel circuit according to the fourth exemplary embodiment. FIG. 16A, FIG. 17A, and FIG. 18A are circuit diagrams of first to third periods. Further, FIG. 16B, FIG. 17B, and FIG. 18B are timing charts of the first to third periods. Note that a two-dot chain line showing a reference number "43" in FIG. 15A is replaced with an arrow for showing a reference number "43" in FIGS. 16A, 17A, and 18A in order to be able better to show the current path. Hereinafter, the operations (driving method) of the pixel circuit according to the fourth exemplary embodiment will be described by adding FIG. 16A to FIG. 18B to FIG. 15A and FIG. 15B.

In the followings, the outline of the driving method of the pixel circuit 40 will be explained by referring to FIG. 15A and FIG. 15B. The driving method of the pixel circuit 40 includes the following first to third periods T1 to T3. In this case, the switch part 43 operates as follows.

First Period T1: The voltage held to the capacitor 12 is initialized, and a constant voltage is applied to the first transistor M41 to temporarily set on the first transistor M41. At this time, the sixth transistor M46 is turned on to guide the electric current supplied from the first transistor M41 to the fourth power supply line P4 by detouring the light emitting element 11.

Second Period T2: The voltage containing the threshold voltage Vth and the data voltage Vdata of the first transistor M41 is held to the capacitor 12.

Third Period T3: Through applying the voltage held to the capacitor 12 to the first transistor M41, the first transistor M41 supplies the electric current according to the voltage applied by the switch part 43 to the light emitting element 11.

Next, each period will be described in more detail. The first period T1 is the initialization period, the second period T2 is a threshold value detecting and data storing period, and the third period T3 is a driving period. Each transistor is of a p-channel type, so that it is turned on when each control signal is L (low) level and turned off when each control signal is H (high) level.

In the first period T1 shown in FIG. 16A and FIG. 16B, the second to sixth transistors M42 to M46 are set on. VDD is supplied from the data line D1. In the first period T1, the second to sixth transistors M42 to M46 are turned on. Thus, the potential VA of the node A and the potential VD of the node D are fixed to Vrst, and the potential VB of the node B is fixed to VDD, respectively. The potential VC of the node C is fixed to VDD at all times. At this time, the electric current i1 for preventing image retention is flown to the sixth transistor M46 via the fourth transistor M44, the first transistor M41, and the fifth transistor M45, so that it does not flow into the light emitting element 11. Therefore, leaked light emission in the first period T1 that is the non-emission period T4 does not occur.

In the second period T2 shown in FIG. 17A and FIG. 17B, the second transistor M42, the third transistor M43, and the sixth transistor M46 are turned on while the fourth transistor M44 and the fifth transistor M45 are turned off. The data voltage Vdata is supplied from the data line D1. Thereby, the potential VB of the node B is fixed to Vdata, the potential VD of the node D is fixed to Vrst, respectively. In the meantime, the potential VA of the node A starts from Vrst and converges to Vdata+Vth when the first transistor M41 is turned off. At this time, the electric current i2 for detecting the threshold voltage Vth is flown to the third transistor M43 from the first transistor M41, so that it does not flow into the light emitting element 11. Therefore, leaked light emission in the second period T2 that is the non-emission period T4 does not occur.

Figure 18A:
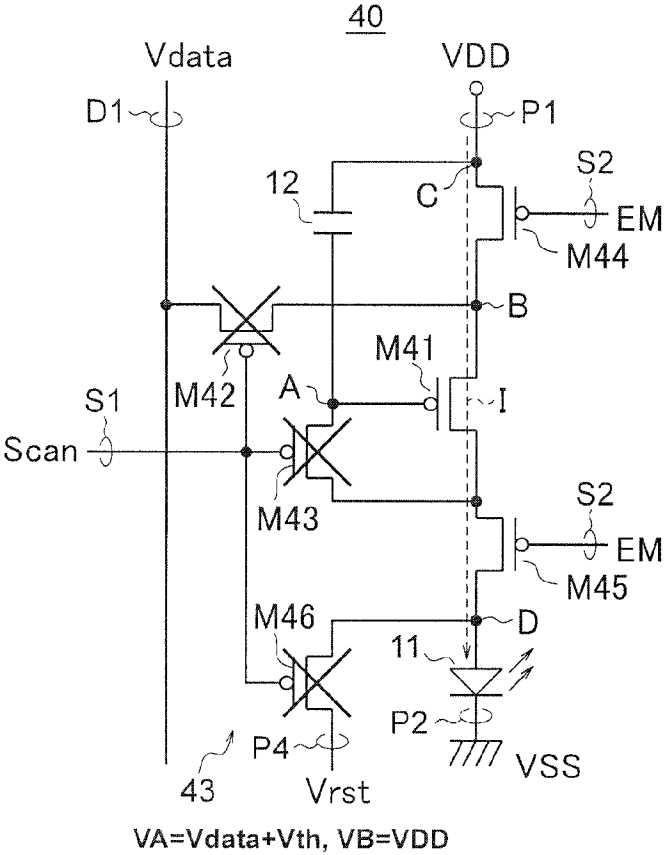
FIG. 18A is a circuit diagram of a third period showing operations (driving method) of the pixel circuit of the fourth exemplary embodiment.

In the third period T3 shown in FIG. 18A and FIG. 18B, the second transistor M42, the third transistor M43, and the sixth transistor M46 are turned off while the fourth transistor M44 and the fifth transistor M45 are turned on. VDD is supplied from the data line D1. Thereby, the potential difference Vdata+Vth−VDD between the both terminals of the capacitor 12 is applied between the gate and the source of the first transistor M41, and the electric current I corresponding thereto is flown to the light emitting element 11 so that the light emitting element 11 radiates light.

The electric current I in this case is given by following expressions.

$$VA = Vdata + Vth$$

$$VB = VDD$$

$$\begin{aligned} \therefore I &= (1/2\beta)((VA - VB) - Vth)^2 \\ &= (1/2\beta)((Vdata + Vth - VDD) - Vth)^2 \\ &= (1/2\beta)(Vdata - VDD)^2 \end{aligned}$$

As shown in the above expressions, the electric current "I" does not include the term of the threshold voltage Vth, so that it is not influenced by variation and fluctuation of the threshold voltage Vth.

It is to be noted that the relations of VDD>VSS≥Vrst apply. For example, VDD=2V, VSS=−8 V, Vrst=−8 V, Vdata=0.5 V to 2.5 V, T1=1 μs, and T2=9 μs.

The switch part 43 may be constituted with six or more transistors. While all the transistors are of p-channel type in the fourth exemplary embodiment, the transistors are not limited to that type. A part of or the whole transistors may be of an n-channel type. In a case where the driving transistor of the OLED is the n-channel type, the conduction direction of the OLED is reversed so that the cathode terminal of the OLED is connected to the drain terminal.

Next, the pixel circuit 40 will be described from another viewpoint.

The pixel circuit 40 includes: the light emitting element 11; the first transistor M41 as the driving transistor; the second transistor M42 which links the data line D1 (Vdata) for supplying a programming voltage to the source terminal (node B) of the first transistor M41 and is gate-controlled by the first control signal Scan; the capacitor 12 as a holding capacitance whose one end (node C) is connected to the first power supply line P1 (VDD) and the other end (node A) is connected to the gate terminal of the first transistor M41; the third transistor M43 which links one end (node A) of the capacitor 12 to the drain terminal of the first transistor M41 and is gate-controlled by the first control signal Scan; the fourth transistor M44 which links the first power supply line P1 (VDD) to the source terminal of the first transistor M41 and is gate-controlled by a second control signal EM; the fifth transistor M45 which links the drain terminal of the first transistor M41 to the first terminal (anode terminal) of the light emitting element 11 and is gate-controlled by the second control signal EM; and the sixth transistor M46 which links the first terminal (anode terminal) of the light emitting element 11 to the fourth power supply line P4 (Vrst) and is gate-controlled by the first control signal Scan.

In the pixel circuit 40, the sixth transistor M46 that connects the first terminal (anode terminal) of the light emitting element 11 to the fourth power supply line P4 (Vrst) is turned on to fix the potential of the first terminal (anode terminal) to the potential (Vrst) of the fourth power supply line P4. With the pixel circuit 40, through setting the potential (Vrst) of the fourth power supply line P4 to be equal to or less than the potential (VSS) of the second power supply line P2, the leaked electric current flown in the light emitting element 11 in the non-emission period T4 can be prevented.

Other structures, operations, and effects of the pixel circuit of the fourth exemplary embodiment are the same as those of the pixel circuits of the first to third exemplary embodiments. Further, a display device provided with the pixel circuit of the fourth exemplary embodiment can be also achieved by replacing the pixel circuit in the display device that employs the pixel circuit of the first exemplary embodiment.

Fifth Exemplary Embodiment

Figure 19B:
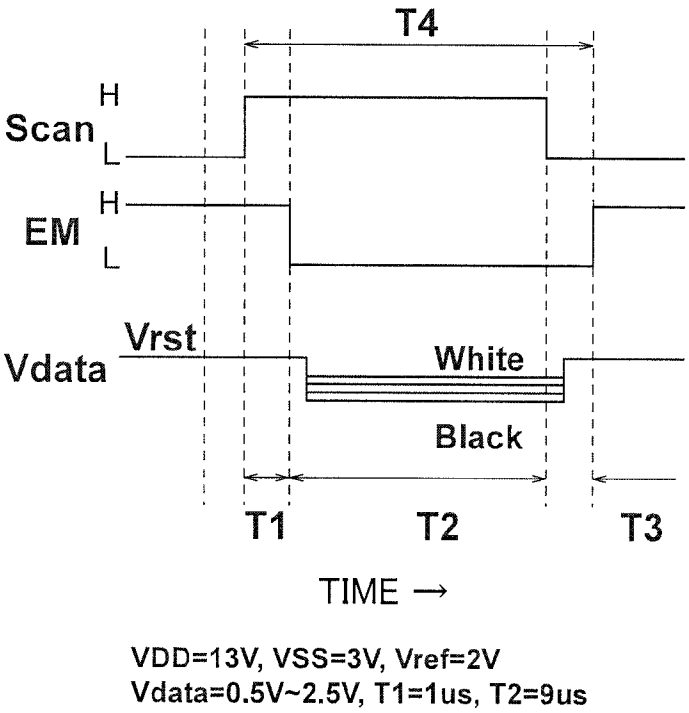
FIG. 19B is a timing chart showing operations of the pixel circuit of the fifth exemplary embodiment.
Figure 19A:
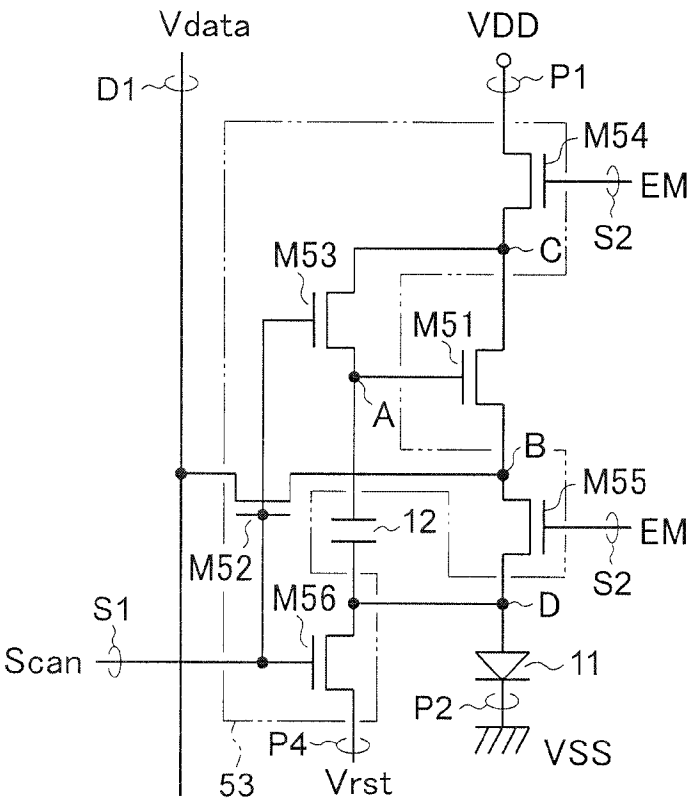
FIG. 19A is a circuit diagram showing the structure of a pixel circuit according to a fifth exemplary embodiment.

FIG. 19A is a circuit diagram showing the structure of a pixel circuit according to a fifth exemplary embodiment, and FIG. 19B is a timing chart showing operations of the pixel circuit of the fifth exemplary embodiment. Explanations will be provided hereinafter by referring to those drawings.

The fifth embodiment employs the structure in which: all the transistors of the fourth exemplary embodiment are replaced with the n-channel types while keeping the second terminal (cathode terminal) of the light emitting element 11 on the substrate side (VSS side); and the layout of the capacitor part (12) connected between the gate and the source as well as the accompanying transistors is changed accordingly. Therefore, the threshold voltage detecting module of the fifth exemplary embodiment is also a diode connection type that is the same as the case of the fourth exemplary embodiment.

That is, the outline of a pixel circuit 50 according to the fifth exemplary embodiment can be described by replacing the driving transistor (M41), the data voltage transistor (M42), the short-circuit transistor (M43), the gate voltage transistor (M44), the power switching transistor (M45), the current detour transistor (M46) and the switch part 43 according to the fourth exemplary embodiment with a driving transistor (M51), a data voltage transistor (M52), a short-circuit transistor (M53), a gate voltage transistor (M54), a power switching transistor (M55), a current detour transistor (M56), and a switch part 53.

In more detail, the pixel circuit 50 is electrically connected to the data line D1, first and second control lines S1, S2, and first, second, and fourth power supply lines P1, P2, and P4, and includes the first to sixth transistors M51 to M56, the capacitor 12, and the light emitting element 11.

The light emitting element 11 includes a first terminal and a second terminal that is electrically connected to the second power supply line P2. The first transistor M51 includes a first terminal, a second terminal, and a control terminal. The second transistor M52 includes: a first terminal electrically connected to the data line D1; a second terminal connected to the second terminal of the first transistor M51; and a control terminal electrically connected to the first control line S1. The third transistor M53 includes: a first terminal electrically connected to the first terminal of the first transistor M51; a second terminal electrically connected to the control terminal of the first transistor M51; and a control terminal electrically connected to the first control line S1. The fourth transistor M54 includes: a first terminal electrically connected to the first power supply line P1; a second terminal electrically connected to the first terminal of the first transistor M51; and a control terminal electrically connected to the second control line S2. The fifth transistor M55 includes: a first terminal electrically connected to the second terminal of the first transistor M51; a second terminal electrically connected to the first terminal of the light emitting element 11; and a control terminal electrically connected to the second control line S2. The sixth transistor M56 includes: a first terminal electrically connected to the first terminal of the light emitting element 11; a second terminal electrically connected to the fourth power supply line P4; and a control terminal electrically connected to the first control line S1. The capacitor 12 includes: a first terminal electrically connected to the control terminal of the first transistor M51; and a second terminal electrically connected to the first terminal of the light emitting element 11.

Note here that the first transistor M51 corresponds to the above-described "driving transistor", the part consisted of the second to the sixth transistors M52 to M56 to the above-described "switch part 53", the sixth transistor M56 to the above-described "current detour transistor", and the capacitor 12 to the above-described "capacitor part", respectively. Further, the data line D1 corresponds to the above-described "data supply line", and the first power supply line P1 to the above-described "power supply voltage line", respectively. The first terminal, the second terminal, and the control terminal of the first transistor M51 correspond to the above-described "source terminal, drain terminal, and gate terminal of the driving transistor". The second transistor M52 corresponds to the above-described "data voltage transistor", the third transistor M53 to the above-described "short-circuit transistor", the fourth transistor M54 to the above-described "gate voltage transistor", and the fifth transistor M55 to the above-described "power switching transistor", respectively.

Figure 20B:
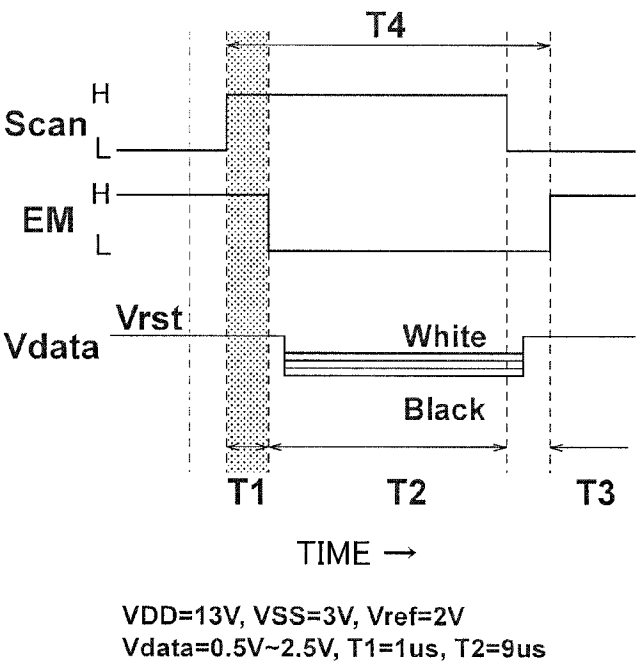
FIG. 20B is a timing chart of the highlighted first period.
Figure 20A:
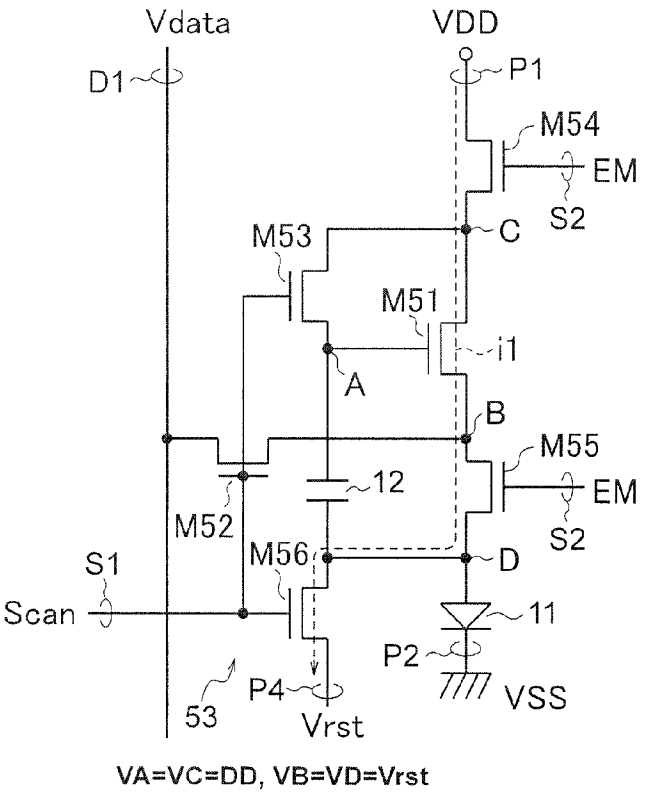
FIG. 20A is a circuit diagram of a first period showing operations (driving method) of the pixel circuit of the fifth exemplary embodiment.
Figure 21B:
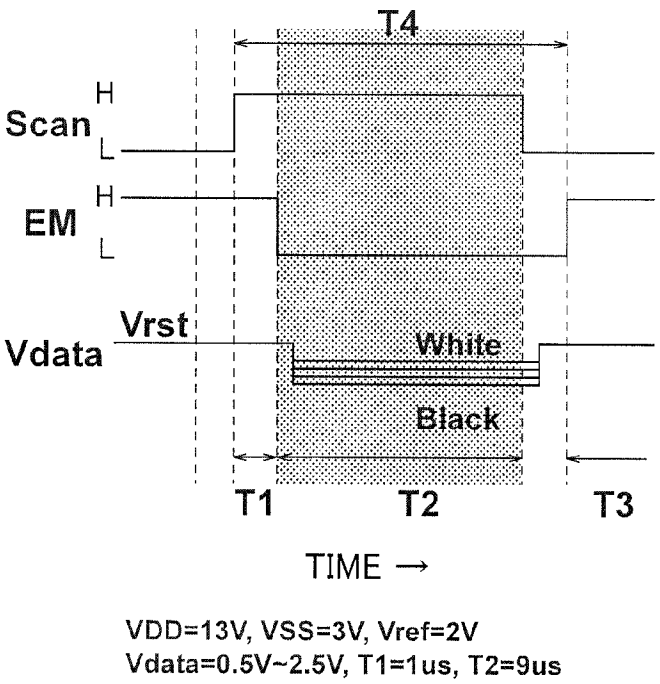
FIG. 21B is a timing chart of the highlighted second period.
Figure 21A:
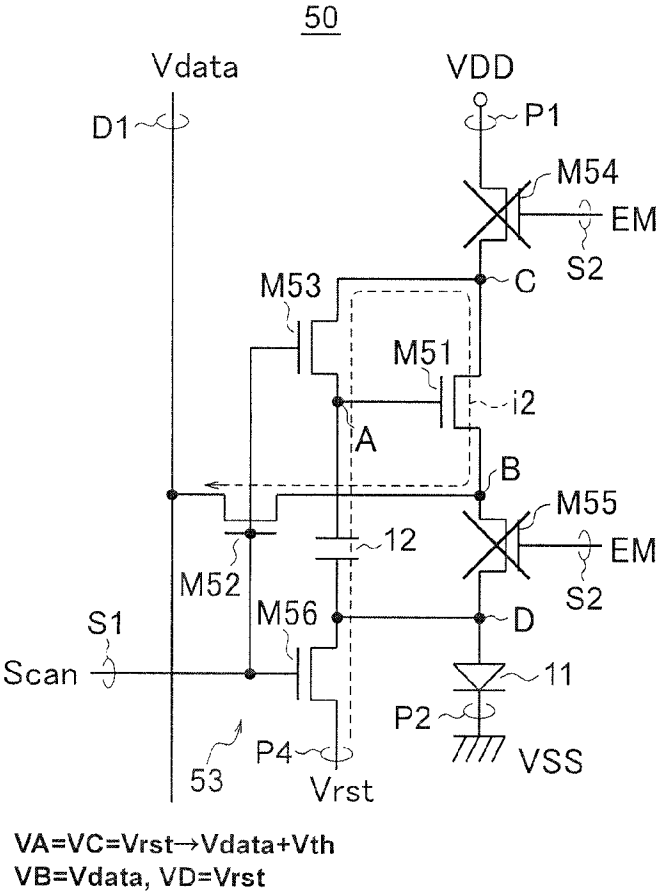
FIG. 21A is a circuit diagram of a second period showing operations (driving method) of the pixel circuit of the fifth exemplary embodiment.
Figure 22B:
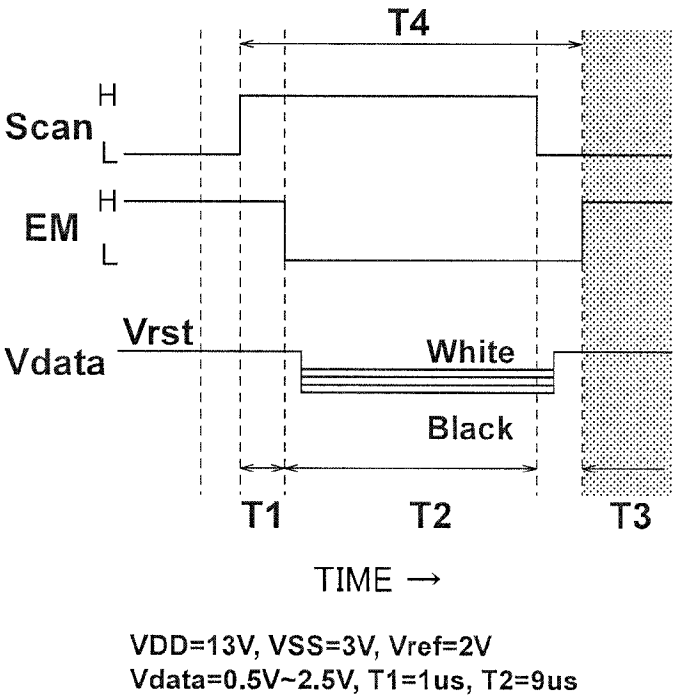
FIG. 22B is a timing chart of the highlighted third period.

FIGS. 20A to 22B show operations (driving method) of the pixel circuit according to the fifth exemplary embodiment. FIG. 20A, FIG. 21A, and FIG. 22A are circuit diagrams of first to third periods. Further, FIG. 20B, FIG. 21B, and FIG. 22B are timing charts of the first to third periods. Note that a two-dot chain line showing a reference number "53" in FIG. 19A is replaced with an arrow for showing a reference number "53" in FIGS. 20A, 21A, and 22A in order to be able better to show the current path. Hereinafter, the operations (driving method) of the pixel circuit according to the fifth exemplary embodiment will be described by adding FIG. 20A to FIG. 22B to FIG. 19A and FIG. 19B.

In the followings, the outline of the driving method of the pixel circuit 50 will be explained by referring to FIG. 19A and FIG. 19B. The driving method of the pixel circuit 50 includes the following first to third periods T1 to T3. In this case, the switch part 53 operates as follows.

First Period T1: The voltage held to the capacitor 12 is initialized, and a constant voltage is applied to the first transistor M51 to temporarily set on the first transistor M51. At this time, the sixth transistor M56 is turned on to guide the electric current supplied from the first transistor M51 to the fourth power supply line P4 by detouring the light emitting element 11.

Second Period T2: The voltage containing the threshold voltage Vth and the data voltage Vdata of the first transistor M51 is held to the capacitor 12.

Third Period T3: Through applying the voltage held to the capacitor 12 to the first transistor M51, the first transistor M51 supplies the electric current to the light emitting element 11 according to the voltage applied by the switch part 53.

Next, each period will be described in more detail. The first period T1 is the initialization period, the second period T2 is a threshold value detecting and data storing period, and the third period T3 is a driving period. Each transistor is of an n-channel type, so that it is turned off when each control signal is L (low) level and turned on when each control signal is H (high) level.

In the first period T1 shown in FIG. 20A and FIG. 20B, the second to sixth transistors M52 to M56 are set on. The reset voltage Vrst is supplied from the data line D1. In the first period T1, the second to sixth transistors M52 to M56 are turned on. Thus, the potential VA of the node A and the potential VC of the node C are fixed to VDD, and the potential VB of the node B and the potential VD of the node D are fixed to Vrst, respectively. At this time, the electric current i1 for preventing image retention is flown to the sixth transistor M56 via the fourth transistor M54, the first transistor M51, and the fifth transistor M55, so that it does not flow into the light emitting element 11. Therefore, leaked light emission in the first period T1 that is the non-emission period T4 does not occur.

In the second period T2 shown in FIG. 21A and FIG. 21B, the second transistor M52, the third transistor M53, and the sixth transistor M56 are turned on while the fourth transistor M54 and the fifth transistor M55 are turned off. The data voltage Vdata is supplied from the data line D1. Thereby, the potential VB of the node B is fixed to Vdata, the potential VD of the node D is fixed to Vrst, respectively. In the meantime, the potential VA of the node A starts from Vrst and converges to Vdata+Vth when the first transistor M51 is turned off. At this time, the electric current i2 for detecting the threshold voltage Vth is flown to the second transistor M52 from the first transistor M51, so that it does not flow into the light emitting element 11. Therefore, leaked light emission in the second period T2 that is the non-emission period T4 does not occur.

Figure 22A:
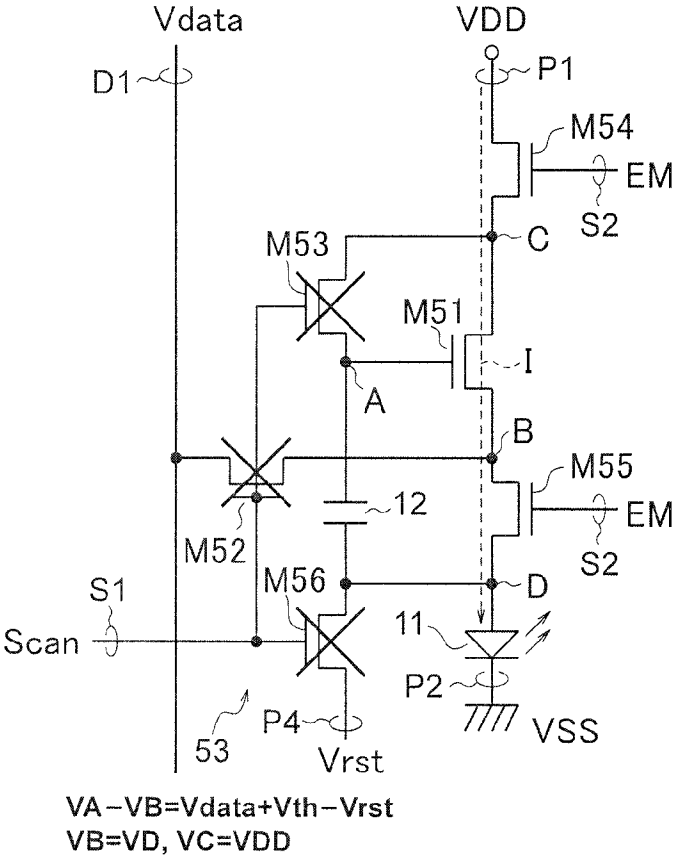
FIG. 22A is a circuit diagram of a third period showing operations (driving method) of the pixel circuit of the fifth exemplary embodiment.

In the third period shown in FIG. 22A and FIG. 22B, the second transistor M52, the third transistor M53, and the sixth transistor M56 are turned off while the fourth transistor M54 and the fifth transistor M55 are turned on. The reset voltage Vrst is supplied from the data line D1. Thereby, the potential difference Vdata+Vth−Vrst between the both terminals of the capacitor 12 is applied between the gate and the source of the first transistor M51, and the electric current I corresponding thereto is flown to the light emitting element 11 so that the light emitting element 11 radiates light.

The electric current I in this case is given by following expressions.

$$VA = Vdata + Vth$$

$$VB = Vrst$$

$$\begin{aligned} \therefore I &= (1/2\beta)((VA - VB) - Vth)^2 \\ &= (1/2\beta)((Vdata + Vth - Vrst) - Vth)^2 \\ &= (1/2\beta)(Vdata - Vrst)^2 \end{aligned}$$

As shown in the above expressions, the electric current "I" does not include the term of the threshold voltage Vth, so that it is not influenced by variation and fluctuation of the threshold voltage Vth.

It is to be noted that the relations of VDD>VSS≥Vrst apply. For example, VDD=13 V, VSS=3 V, Vrst=2 V, Vdata=0.5 V to 2.5 V, T1=1 μs, and T2=9 μs.

The switch part 53 may be constituted with six or more transistors. While all the transistors are of n-channel type in the fifth exemplary embodiment, the transistors are not limited to that type. A part of or the whole transistors may be of a p-channel type. In a case where the driving transistor of the OLED is the p-channel type, the conduction direction of the OLED is reversed so that the cathode terminal of the OLED is connected to the source terminal.

Next, the pixel circuit 50 will be described from another viewpoint.

The pixel circuit 50 includes: the light emitting element 11; the first transistor M51 as the driving transistor; and the second transistor M52 which links the data line D1 for supplying a programming voltage to the source terminal (node B) of the first transistor M51 and is gate-controlled by the first control signal Scan. Further, the pixel circuit 50 includes: the capacitor 12 as a holding capacitance whose one end (node D) is connected to the fourth power supply line P4 (Vrst) and the other end (node A) is connected to the gate terminal of the first transistor M51; the third transistor M53 which links the end (node A) of the capacitor 12 to the drain terminal of the first transistor M51 and is gate-controlled by the first control signal Scan; the fourth transistor M54 which links the first power supply line P1 (VDD) to the drain terminal of the first transistor M51 and is gate-controlled by a second control signal EM; the fifth transistor M55 which links the source terminal of the first transistor M51 to the first terminal of the light emitting element 11 and is gate-controlled by the second control signal EM; and the sixth transistor M56 which links the first terminal of the light emitting element 11 to the fourth power supply line P4 (Vrst) and is gate-controlled by the first control signal Scan.

In the pixel circuit 50, the sixth transistor M56 that connects the first terminal (anode terminal) of the light emitting element 11 to the fourth power supply line P4 (Vrst) is turned on to fix the potential of the first terminal (anode terminal) of the light emitting element 11 to the potential (Vrst) of the fourth power supply line P4. At the same time, in a period where the fourth to sixth transistors M54, M55, and M56 are turned on simultaneously, an electric current is flown to the fourth power supply line P4 (Vrst) from the first power supply line P1 (VDD) via the first transistor M51. With the pixel circuit 50, through setting the potential (Vrst) of the fourth power supply line P4 to be equal to or less than the potential (VSS) of the second power supply line P2, the leaked electric current flown in the light emitting element 11 in the non-emission period T4 can be prevented. Further, with the pixel circuit 50, image retention can be prevented through the electric current flows to the first transistor M51 before lighting up the light emitting element 11.

Other structures, operations, and effects of the pixel circuits of the fifth exemplary embodiment are the same as those of the pixel circuits of the first to fourth exemplary embodiments. Further, a display device provided with the pixel circuit of the fifth exemplary embodiment can be also achieved by replacing the pixel circuit in the display device that employs the pixel circuit of the first exemplary embodiment.

Sixth Exemplary Embodiment

Figure 23B:
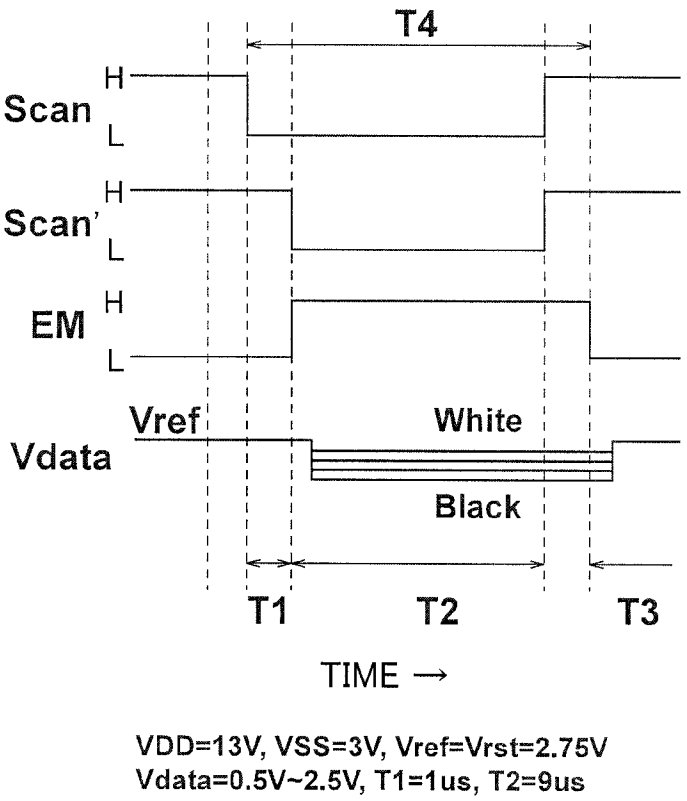
FIG. 23B is a timing chart showing operations of the pixel circuit of the sixth exemplary embodiment.
Figure 23A:
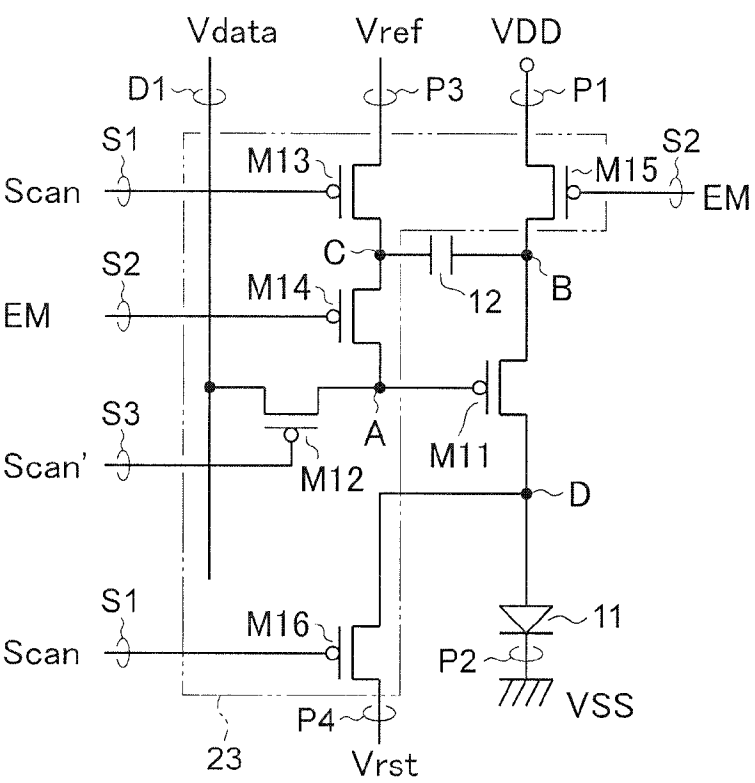
FIG. 23A is a circuit diagram showing the structure of a pixel circuit according to a sixth exemplary embodiment.
Figure 24A:
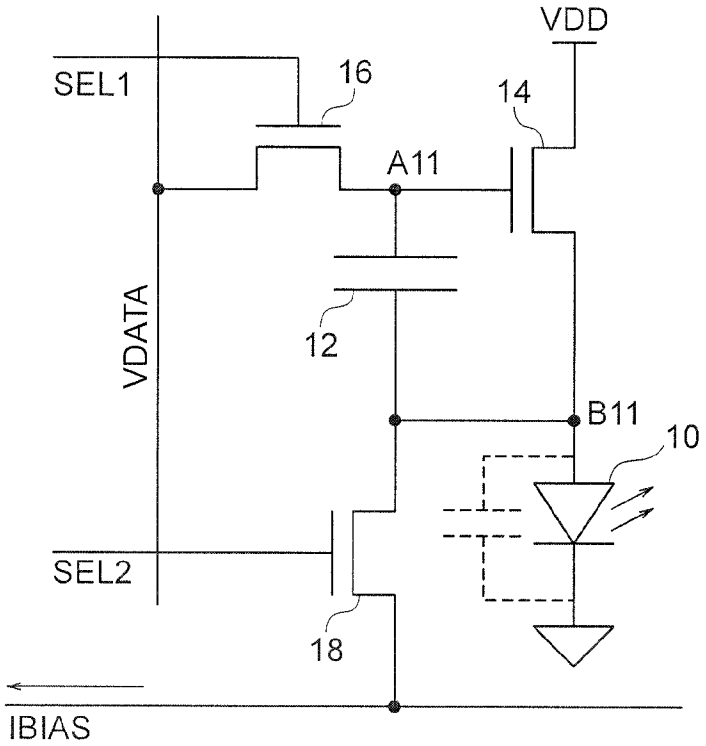
FIG. 24A is a circuit diagram showing the structure of a pixel circuit according to Related Art 1.
Figure 24B:
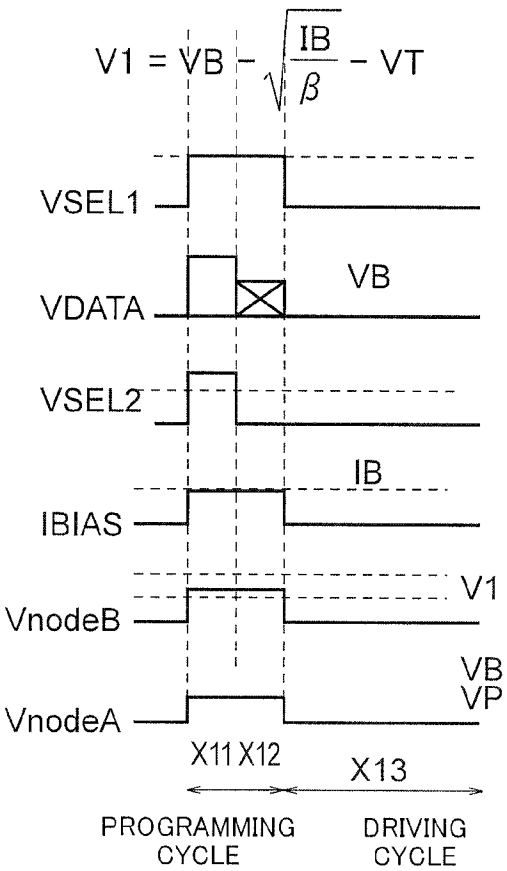
FIG. 24B is a timing chart showing operations of the pixel circuit of Related Art 1.
Figure 25B:
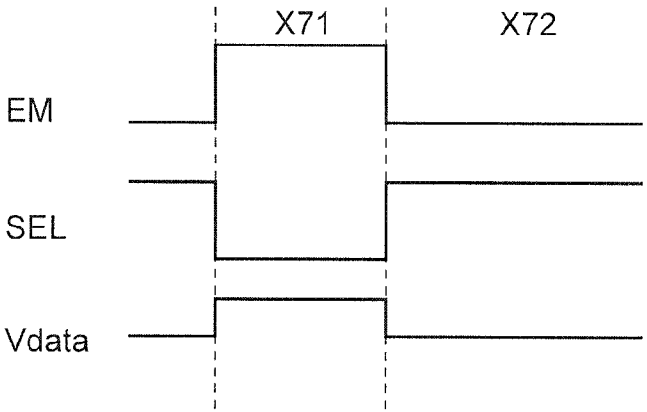
FIG. 25B is a timing chart showing operations of the pixel circuit of Related Art 2.
Figure 25A:
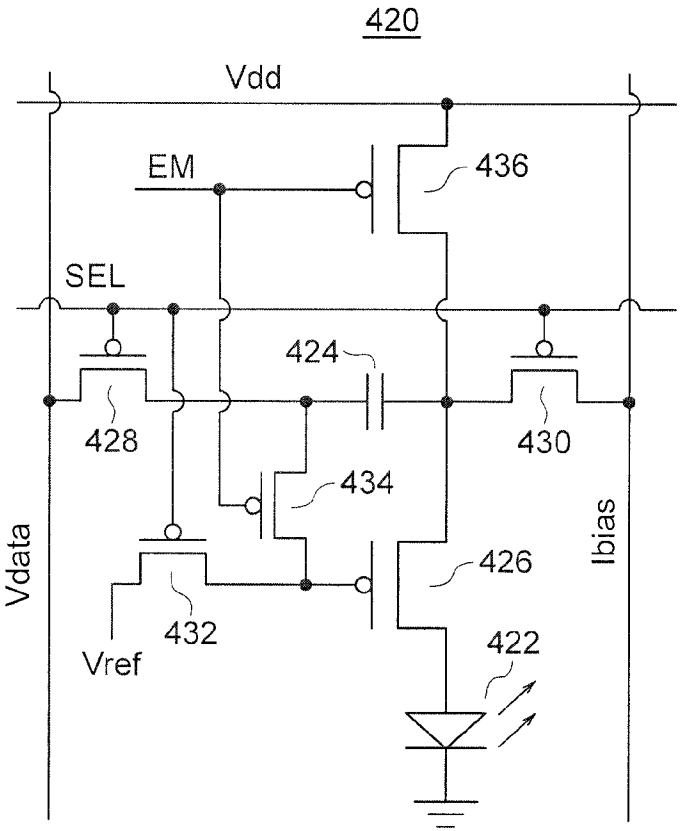
FIG. 25A is a circuit diagram showing the structure of a pixel circuit according to Related Art 2.
Figure 26B:
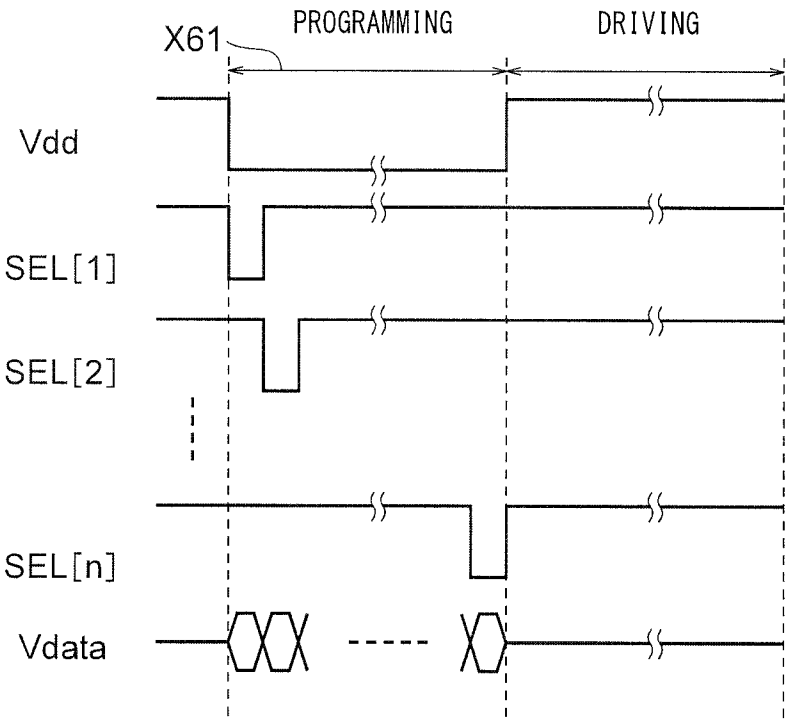
FIG. 26B is a timing chart showing operations of the pixel circuit of Related Art 3.
Figure 26A:
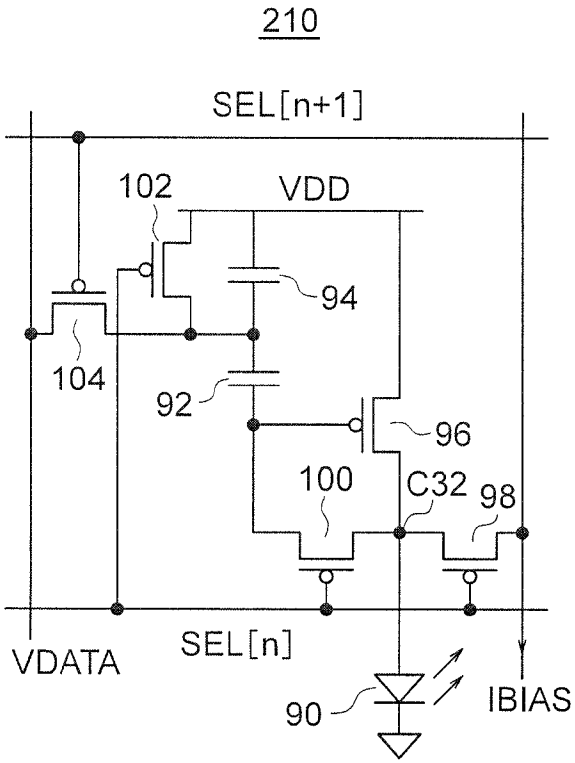
FIG. 26A is a circuit diagram showing the structure of a pixel circuit according to Related Art 3.
Figure 27B:
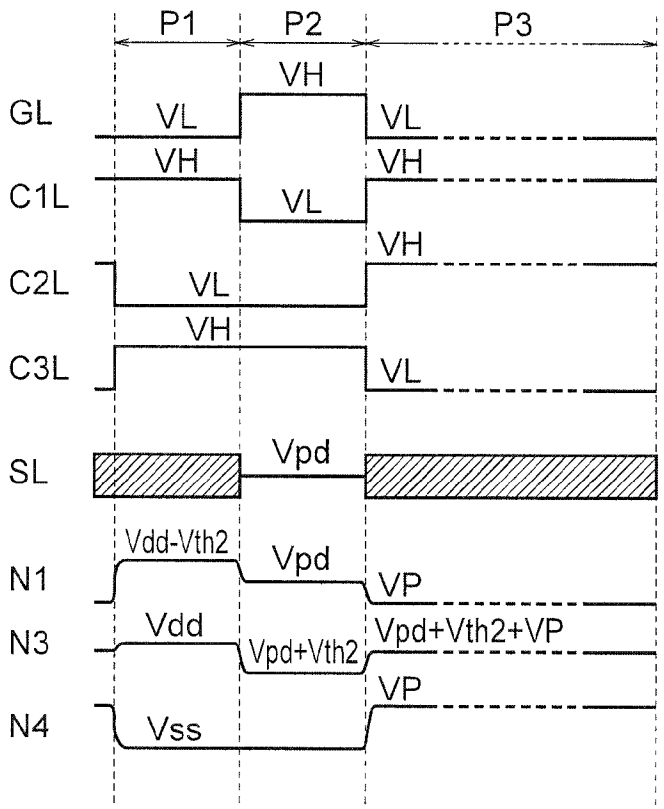
FIG. 27B is a timing chart showing operations of the pixel circuit of Related Art 4.
Figure 27A:
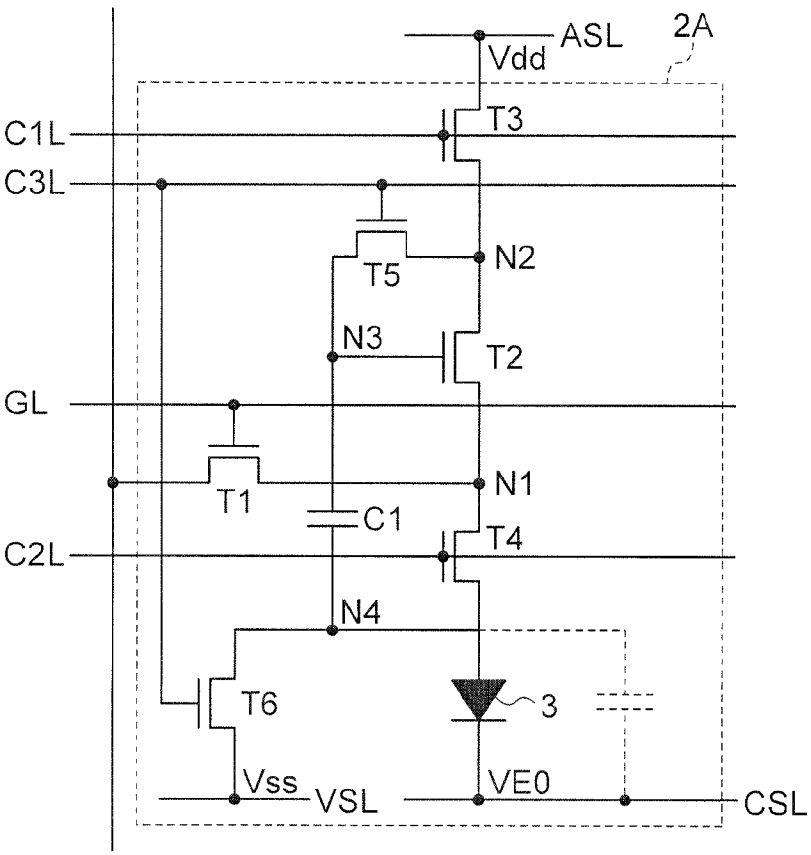
FIG. 27A is a circuit diagram showing the structure of a pixel circuit according to Related Art 4.

FIG. 23A is a circuit diagram showing the structure of a pixel circuit according to a sixth exemplary embodiment, and FIG. 23B is a timing chart showing operations of the pixel circuit of the sixth exemplary embodiment. Explanations will be provided hereinafter by referring to those drawings.

A pixel circuit 60 of the sixth exemplary embodiment is different from that of the second exemplary embodiment in respect that it is further connected to a third control line S3 electrically and the control terminal of the second transistor M12 is electrically connected to the third control line S3 instead of the first control line S1. A third control signal Scan' that is different from the first control signal Scan is outputted from the third control line S3. That is, in the first period T1, the third control signal Scan' becomes the H level while the first control signal Scan becomes the L level.

Thus, the second transistor M12 is turned off in the first period T1, so that there is no short-circuit current generated via the second transistor M12 even when Vdata # Vref. Therefore, with the pixel circuit 60, output timing of the data voltage Vdata can be set without a restriction.

Other structures, operations, and effects of the pixel circuits of the sixth exemplary embodiment are the same as those of the pixel circuits of the first to fifth exemplary embodiments. Further, a display device provided with the pixel circuit of the sixth exemplary embodiment can be also achieved by replacing the pixel circuit in the display device that employs the pixel circuit of the first exemplary embodiment. Further, the sixth exemplary embodiment can be applied not only to the second exemplary embodiment but also to the other exemplary embodiments as well.

While the present invention has been described by referring to each of the above exemplary embodiments, the present invention is not limited only to the structures and the operations of each of the above-described exemplary embodiments but includes various kinds of changes and modifications occurred to those skilled in the art without departing from the scope of the present invention. Further, the present invention also includes those acquired by combining a part of or a whole part of each of the above-described exemplary embodiments as appropriate.

Furthermore, the present invention can also be expressed in a following manner.

The pixel circuit according to the present invention prevents invalid light emission in a non-emission period through: connecting the driving transistor to the terminal of the OLED via the emission transistor; initially charging the terminal of the driving transistor and the holding capacitance in the initialization period where the both transistors become conductive simultaneously; and not flowing the electric current flowing in that state to the OLED but flowing it to the bypass transistor. Further, in the pixel circuit according to the present invention, a constant electric current is flown to the driving transistor every time the voltage between the terminals of the holding capacitance is reset before detecting the threshold voltage. Thereby, image retention (delay when switching to all-white display from all-black display) can be prevented. As a cause for generating the image retention, there is shift of the threshold voltage of the driving transistor that is constituted with LTPSTFT, which is generated when an electric current is not flown for a long time in continuous black display.

The structures of the present invention are as follows. It is an OLED pixel structure, in which: the switch for connecting the anode terminal to the power supply line is provided; and the switch is set conductive in the non-emission period to fix the applied voltage to the OLED. At the same time, the switch is used as the path for the electric current that flows to the driving transistor or as the path for resetting the terminal of the driving transistor and the holding capacitance. Further, the driving transistor is diode-connected at the time of resetting the holding capacitance to have a constant electric current flown to the driving transistor.

The operation of the present invention is as follows. The bypass transistor is connected to the terminal that is connected to the driving transistor out of the two terminals of the OLED element, and the electric current flown to detect the threshold voltage of the driving transistor is not flown to the OLED element but flown to the bypass transistor so as to prevent invalid light emission in the non-emission period.

The effect of the present invention is as follows: The leaked light emission of the OLED can be prevented. Through fixing the potential of the drain terminal of the driving transistor at the time of detecting the threshold value, operations in the saturation region can be guaranteed. It is possible to reset the holding capacitance securely, and to initialize the voltage between the gate and the source of the driving transistor to be equal to or larger than the threshold value. The image retention can be prevented.

For example, with the present invention, the transistor conduction type and the electrode type of the light emitting element are not limited. The circuit connection is common to the case where the anode side of the light emitting element is connected to the driving transistor and to the case where the cathode side of the light emitting element is connected to the driving transistor, so that the present invention is effective for the both cases. Therefore, the both cases are included in the present invention.

What is claimed is:

1. A pixel circuit, comprising:

a light emitting element;

a driving transistor which supplies an electric current to the light emitting element according to a voltage applied to a gate terminal of the driving transistor;

a capacitor part which holds an emitting voltage containing a threshold voltage of the driving transistor and a data voltage; and a switch part which holds the emitting voltage in the capacitor part, and applies the emitting voltage which is held by the capacitor part to the gate terminal of the driving transistor, wherein the switch part applies a prescribed voltage to the gate terminal of the driving transistor, and the driving transistor supplies an electric current corresponding to the prescribed voltage which is applied by the switch part, before making the capacitor part hold the emitting voltage, the switch part further comprises a current detour transistor which makes the electric current supplied from the driving transistor detour without flowing through the light emitting element before making the capacitor part hold the emitting voltage, and the electric current supplied from the driving transistor corresponds to the prescribed voltage, the driving transistor comprises the gate terminal, a source terminal, and a drain terminal, and supplies an electric current according to a voltage applied between the gate terminal and the source terminal to the light emitting element that is connected in series to the drain terminal and the source terminal, the switch part comprises:

a data voltage transistor which inputs the data voltage from a data supply line, a reference voltage transistor which inputs a reference voltage from a reference voltage line, a gate voltage transistor which applies the voltage held to the capacitor part between the gate terminal and the source terminal, and a power switching transistor which function as a switch of an electric current flown to the drain terminal and the source terminal from a power supply voltage line, the switch part applies the constant voltage between the gate terminal and the source terminal by turning on the data voltage transistor, the reference voltage transistor, the gate voltage transistor, and the power switching transistor, the switch part makes the capacitor part hold the voltage containing the threshold voltage and the data voltage by turning on the data voltage transistor and the reference voltage transistor and turning off the gate voltage transistor and the power switching transistor, and the switch part applies the voltage held to the capacitor part between the gate terminal and the source terminal by turning off the data voltage transistor and the reference voltage transistor and turning on the gate voltage transistor and the power switching transistor.

* * * * *